US011118357B2

(12) United States Patent
Anthony

(10) Patent No.: US 11,118,357 B2
(45) Date of Patent: Sep. 14, 2021

(54) EDGE FLASHING FOR ROOFS WITH FUNCTIONAL SURFACE MATERIALS

(71) Applicant: Eli W. Anthony, Minneapolis, MN (US)

(72) Inventor: Eli W. Anthony, Minneapolis, MN (US)

( * ) Notice: Subject to any disclaimer, the term of this patent is extended or adjusted under 35 U.S.C. 154(b) by 0 days.

(21) Appl. No.: 16/575,102

(22) Filed: Sep. 18, 2019

(65) Prior Publication Data

US 2020/0011062 A1 Jan. 9, 2020

Related U.S. Application Data

(63) Continuation of application No. 15/189,636, filed on Jun. 22, 2016, now Pat. No. 10,465,387.
(Continued)

(51) Int. Cl.
*E04D 13/15* (2006.01)
*E04D 13/072* (2006.01)
(Continued)

(52) U.S. Cl.
CPC ..... *E04D 13/0727* (2013.01); *E04D 13/0459* (2013.01); *E04D 13/064* (2013.01);
(Continued)

(58) Field of Classification Search
CPC ..... E04D 13/15; E04D 13/076; E04D 13/064; E04D 13/155; E04D 13/0459; E04D 13/158
See application file for complete search history.

(56) References Cited

U.S. PATENT DOCUMENTS 1,090,985 A 3/1914 Hopkins
1,624,121 A 4/1927 Thiem
(Continued)

FOREIGN PATENT DOCUMENTS

DE 19724445 10/1997
EP 1970499 9/2008

OTHER PUBLICATIONS

Application and File History for U.S. Appl. No. 15/189,636, filed Jun. 22, 2016, Inventor: Eli Anthony.
(Continued)

*Primary Examiner* — Brian E Glessner
*Assistant Examiner* — Daniel J Kenny
(74) *Attorney, Agent, or Firm* — Patterson Thuente Pedersen, P.A.

(57) ABSTRACT

Flashing for use at the edge of roofs or decks that are provided with surface materials are presented. In exemplary embodiments, flashing may be provided at the edge of a roof to retain or provide an edge treatment for an aesthetic and functional surface material, such as, for example, a cast paver, while at the same time allowing for water drainage. In one embodiment, a piece of flashing material contains a leg that is fastened along the edge of the top of a flat roof. This embodiment continues into two legs that form a V-shaped trough which comes off the roofing membrane and has penetrations at the bottom to release water. The outer leg of the "V" most commonly extends to a level higher than the roofing membrane in order to make contact with and edge an installed surface material. Various other shapes and end treatments, including various embodiments providing both an edge flashing as well as an integrated rectangular shaped gutter-like trough are also presented.

18 Claims, 32 Drawing Sheets

Related U.S. Application Data

(60) Provisional application No. 62/332,302, filed on May 5, 2016, provisional application No. 62/183,547, filed on Jun. 23, 2015.

(51) Int. Cl.
*E04D 13/076* (2006.01)
*E04D 13/064* (2006.01)
*E04D 13/04* (2006.01)

(52) U.S. Cl.
CPC ..... *E04D 13/076* (2013.01); *E04D 13/15* (2013.01); *E04D 2013/0468* (2013.01); *E04D 2013/0472* (2013.01)

(56) References Cited

U.S. PATENT DOCUMENTS 2,032,967 A 3/1936 Zorn
2,847,949 A * 8/1958 Pond ..... E04D 13/076 52/12
3,242,622 A 3/1966 Snead
3,389,515 A 6/1968 Hellebrand
3,432,976 A 3/1969 Berg
4,631,875 A * 12/1986 Olson ..... E04D 13/064 248/48.2
4,780,999 A 11/1988 Web
4,912,888 A * 4/1990 Martin ..... E04D 13/0727 405/119
5,170,597 A 12/1992 Stearns
5,414,965 A 5/1995 Kelley
5,927,023 A 7/1999 Kittilstad
5,960,591 A 10/1999 Schluter
6,035,587 A * 3/2000 Dressier ..... E04D 13/0459 52/716.2
7,546,719 B1 6/2009 Guevara
7,614,185 B2 11/2009 Brochu
8,734,970 B2 6/2014 Wayne
9,200,454 B2 12/2015 Little
2003/0159379 A1 8/2003 Pickier
2015/0300014 A1 * 10/2015 Bowman ..... E04B 1/003 52/302.1

OTHER PUBLICATIONS

Application and File History for U.S. Appl. No. 16/847,586, filed Apr. 13, 2020, Inventor: Eli Anthony.

* cited by examiner

EDGE FLASHING FOR ROOFS WITH FUNCTIONAL SURFACE MATERIALS

RELATED APPLICATION

This application is a continuation of application Ser. No. 15/189,636 filed Jun. 22, 2016, which claims the benefit of U.S. Provisional Application No. 62/332,302, filed May 5, 2016 and U.S. Provisional Application No. 62/183,547, filed Jun. 23, 2015, each of which is hereby fully incorporated herein by reference.

TECHNICAL FIELD

This application relates to roofing and waterproofing materials, and in particular to flashing for use at the edge of flat roofs or pitched to retain or edge an aesthetic and functional surface material such as a cast paver, while at the same time allowing for water drainage.

BACKGROUND

Conventionally, when a relatively flat (including slightly pitched) roof is used as a functional balcony or terrace, material is installed over (on top of) the waterproofing membrane/roofing both for aesthetic and practical reasons. Examples of this include a wood deck with non-penetrating framing (sleepers), or a cast paver (such as a split brick paver). Another surface material (somewhat less common) can be, for example, a poured concrete surface with expansion joints.

Installation of such surface material extends the life of the waterproofing membrane or roofing by protecting it from foot traffic as well as from the elements. Such surface material can also weigh down the waterproofing membrane, thus helping to ensure that over time it is less likely to pull away from substrate, especially around the edges.

It is noted that water is likely to penetrate an installed surface material. If a roof has a pitch—for example, the International Residential Code requires a minimum pitch of ¼" per foot—directed towards one or more of the edges, rain water will end up at these edges.

Sometimes, in such cases, a roofing membrane is adhered down the outside vertical surface of the perimeter fascia. Additionally, the roofing membrane may overlap with, and deposit water into, a gutter. This technique generally exposes the full outside edge of the installed surface material as well as the vertical leg of the roofing membrane that overlaps the fascia or gutter. In such instances, the roofing membrane may rely solely on an adhesive to remain attached to the vertical outside face of the fascia or inside vertical face of gutter. An alternative that may be desirable both for aesthetic and structural purposes would include the utilization of an installed edging flashing.

Such an installed edging flashing can act to retain the installed surface material which can, by virtue of its weight, apply pressure onto the perimeter of the roofing membrane thereby helping it to stay adhered. Such edging flashing can also hide the lower outside perimeter edge of the surface material, any substructure for the surface material or drainage material, and the roofing membrane. Some may consider this utilization of an edging flashing to be more aesthetically pleasing.

It is important to allow for drainage when installing an edging flashing that rises above the upper surface of the membrane in order to border/retain/edge an installed surface material. If the roof is pitched towards one or more of the roof edges, water must be directed out and away from the roof, into a water collection device such as a gutter.

Conventionally, there are many devices used to edge the perimeter of a roof and retain a surface material. These devices, however, do not allow for water drainage if water were to get under the installed surface material. Accordingly, such devices can be of service if drainage occurs somewhere within the roof area and the roof is pitched towards that drain. However, when water is directed by the pitch of the roof towards the outer edges, ponding will occur if the edging system does not allow for that water to pass. Also, such conventional devices generally consist of two or more parts, making them both more difficult to install and more costly to manufacture—especially devices using extruded components.

Some devices utilize holes in the vertical edging in order to manage water. If a surface material butts into such a vertical edge, the holes may be partially or completely blocked so that the water may be slow to release and ponding can still occur. Additionally, the aesthetic of having visible holes along the edge flashing may not be desirable.

Edging with holes in the outer vertical surface may also not account for a variance of pressure applied by the surface material. Often a roof surface is not perfectly square. In such instances, the installed surface material may have to be cut at a slight angle or the surface material may push at different pressures along the edging. In this case it would be useful to have some flexing range in the edging product that helps take into account this variation in layout. If a conventional vertical edging surface is pressed out by the abutment of an installed surface material, a gap may start to open up between the edging and the surface material. Such a gap could collect debris over time and become less aesthetically pleasing. Also, such edging may become noticeably pitched if pressed out by the abutting surface material.

One example of a one-piece flashing that is used as edging on a flat roof is shown in U.S. Pat. No. 8,739,470. The single piece of flashing folds over the side of a roof, protrudes downward, and then folds over itself, having an outer vertical edge that rises up over the level of an installed surface material, and folds over, at a ninety degree angle, the installed surface material, which is then clamped down by the top horizontal surface of the flashing, as shown in FIGS. 1-3 thereof. One challenge of such flashing is that there are many different thicknesses of surface material. The flashing would need to come in many sizes to accommodate the varying thicknesses of available material, or have the ninety degree fold where the outer vertical face becomes the top horizontal face be bent (or unbent) to accommodate different sizes. Also, if the desired surface material to be installed is not of consistent thickness, gaps under the irregular upper horizontal surface of the flashing could collect debris.

The top horizontal surface of the flashing (item 16 in FIGS. 1-3) that covers the surface material may also need to be adjusted or cut if posts for a guard railing are installed close to the roof edge. It is here noted that the International Building Code requires decks, terraces and balconies to have a guard rail if they are of a height greater than thirty-two inches (32") off of the ground.

What is thus needed in the art are flashing treatments that overcome the above-described problems of the prior art.

SUMMARY

Flashing for use at the edge of roofs or decks that are provided with surface materials are presented. In exemplary embodiments, flashing may be provided at the edge of a roof to retain or provide an edge treatment for an aesthetic and functional surface material, such as, for example, a cast paver, while at the same time allowing for water drainage. In one embodiment, a piece of flashing material contains a leg that is fastened along the edge of the top of a flat roof. This embodiment continues into two legs that form a V-shaped trough which comes off the roofing membrane and has penetrations at the bottom to release water. The outer leg of the "V" most commonly extends to a level higher than the roofing membrane in order to make contact with and edge an installed surface material. Various other shapes and end treatments, including various embodiments providing both an edge flashing as well as an integrated rectangular shaped gutter-like trough are also presented.

BRIEF DESCRIPTION OF THE DRAWINGS

FIG. 4 depicts a perspective view of a variation of the exemplary flashing of FIG. 1 where the acute angle at the bottom of the vertical portion of the flashing edge is greater, causing the top of the outer vertical leg (118) to be offset at a distance away from the installed surface material, and where at the top of the outer vertical leg (118) there is provided an additional fourth leg (106) that angles back towards the installed surface material and thus traverses this distance.

FIG. 5 depicts a side view of the exemplary flashing of FIG. 4.

FIG. 6 depicts a top view of the exemplary flashing of FIG. 4.

FIG. 7 depicts a perspective view of yet another variation of the exemplary flashing edging of FIGS. 1-3 where the additional fourth leg (provided at the top of the outer vertical leg) is rounded as opposed to planar.

FIG. 8 depicts a side view of the exemplary flashing edging of FIG. 7.

FIG. 9 depicts a top view of the exemplary flashing edging of FIG. 7.

FIG. 10 depicts a perspective view of variation of the exemplary flashing edging of FIGS. 7-9, where the outer leg a has a wavy shape, and the upper portion of said outer leg edge curves backwards towards, and abuts, the installed surface material (106).

FIG. 11 depicts a side view of the exemplary flashing edging of FIG. 10.

FIG. 12 depicts a top view of the exemplary flashing edging of FIG. 10.

FIG. 13 depicts a perspective view of another alternate exemplary embodiment of flashing edging, provided with a cylindrical front leg that creates its own gutter-like trough according to exemplary embodiments of the present disclosure; the outer leg of the flashing descends downwards from the roof surface, and then curves upwards so as to traverse an approximate 270 degree arc to about the installed surface material (106).

FIG. 14 depicts a side view of the exemplary flashing edging of FIG. 13, clearly showing the seam 215 at the top portion of the outer leg that abuts the installed surface material 106.

FIG. 15 depicts a top view of the exemplary flashing edging of FIG. 13.

FIG. 16 depicts yet another alternate exemplary embodiment of flashing edging, provided with an offset vertical front leg that forms a gutter-like trough, and which further has a slotted horizontal to vertical swale shaped cover, in the nature of a leaf guard, that extends laterally back to the front edge of installed roofing surface material according to exemplary embodiments of the present disclosure.

FIG. 17 is a side view of the exemplary flashing edging of FIG. 16.

FIG. 18 is a top view of the exemplary flashing edging of FIG. 16.

FIG. 19 depicts an exemplary edging flashing provided with an upper horizontal leg that extends forward from the roof so as to support an overhang of roofing material, then folds under itself and forms, with a downward, horizontal, and upwards portion, a rectangular trough, whose forward face abuts and thus holds the front edge of the overhanging roofing material according to exemplary embodiments of the present disclosure.

FIG. 20 is a side view of the exemplary flashing edging of FIG. 19.

FIG. 21 is a top view of the exemplary flashing edging of FIG. 19.

FIG. 22 depicts yet another variation of the exemplary flashing shown in FIGS. 19-21, where the upper horizontal leg protrudes sufficiently away from the roof so as to touch the outside vertical leg, forming a rectangular tube structure, and is further perforated or provided with numerous slots to allow water to enter the rectangular trough, and thereby drain the roof runoff, according to exemplary embodiments of the present disclosure.

FIG. 23 depicts a side view of the exemplary flashing edging of FIG. 22.

FIG. 24 depicts a top view of the exemplary flashing edging of FIG. 22.

FIG. 25 depicts an alternate exemplary edging flashing with a rectangular shape that creates a gutter-like trough, has a vertical leg (519) that abuts against a roofs surface material, and further has a gap between it and a horizontal leg coming off of the roof allowing water to enter the gutter-like trough, according to alternate exemplary embodiments of the present disclosure.

FIG. 26 is a side view of the exemplary flashing edging of FIG. 25.

FIG. 27 is a top view of the exemplary flashing edging of FIG. 25.

FIG. 29 depicts a perspective views of another alternate exemplary edging flashing with a rectangular shape that creates a gutter-like trough, has a rear vertical leg (519) that abuts against a roofs surface material, and further has an angled leg (520) with perforations, that angles down from the rear vertical leg to meet the horizontal leg installed on the roof, according to alternate exemplary embodiments of the present disclosure.

FIG. 30 is a side view of the exemplary flashing edging of FIG. 29.

FIG. 31 is a top view of the exemplary flashing edging of FIG. 30.

DETAILED DESCRIPTION

Various exemplary embodiments of novel types of flashing are described. In exemplary embodiments of the present disclosure, the flashing can serve as an edging, providing support for an applied surface material on a roof, which in turn provides protection for a roofing membrane. A horizontal (or pitched parallel to the pitch of the underlying roof) leg of the novel flashing can be installed under such an applied surface material, for example, thus augmenting the solidity and longevity of the installation.

Exemplary flashing can, for example, be installed under a roofing membrane using mechanical fasteners, construction adhesive, or the like, or, for example, it can be installed over the roofing membrane using an adhesive flashing tape (e.g., a marginal strip that is compatible with a given roofing membrane) that overlaps both the flashing and the roofing membrane.

In exemplary embodiments of the present disclosure, an exemplary flashing can provide a two-fold approach for managing water. First, the flashing can allow water that gets under an installed surface material to flow down and away from the surface of the roof and fascia. It thus utilizes the surface material as a guard, like a gutter guard, so that unwanted debris may be blocked from a V-shaped trough at a bottom edge of the flashing, and water flow is less likely to be impeded. Secondly, water that flows over the top of an installed surface material and along the outside of the flashing can go down to the bottom of the V-shaped trough provided in the flashing assembly where it drips out. In such exemplary embodiments, the flashing performs like a drip edge. Similarly, water that flows under an installed surface material can flow down into the bottom of the V-shaped trough provided in the flashing assembly where it drips through the provided holes and can be collected by a water collection device such as, for example, a gutter.

Figure 1:
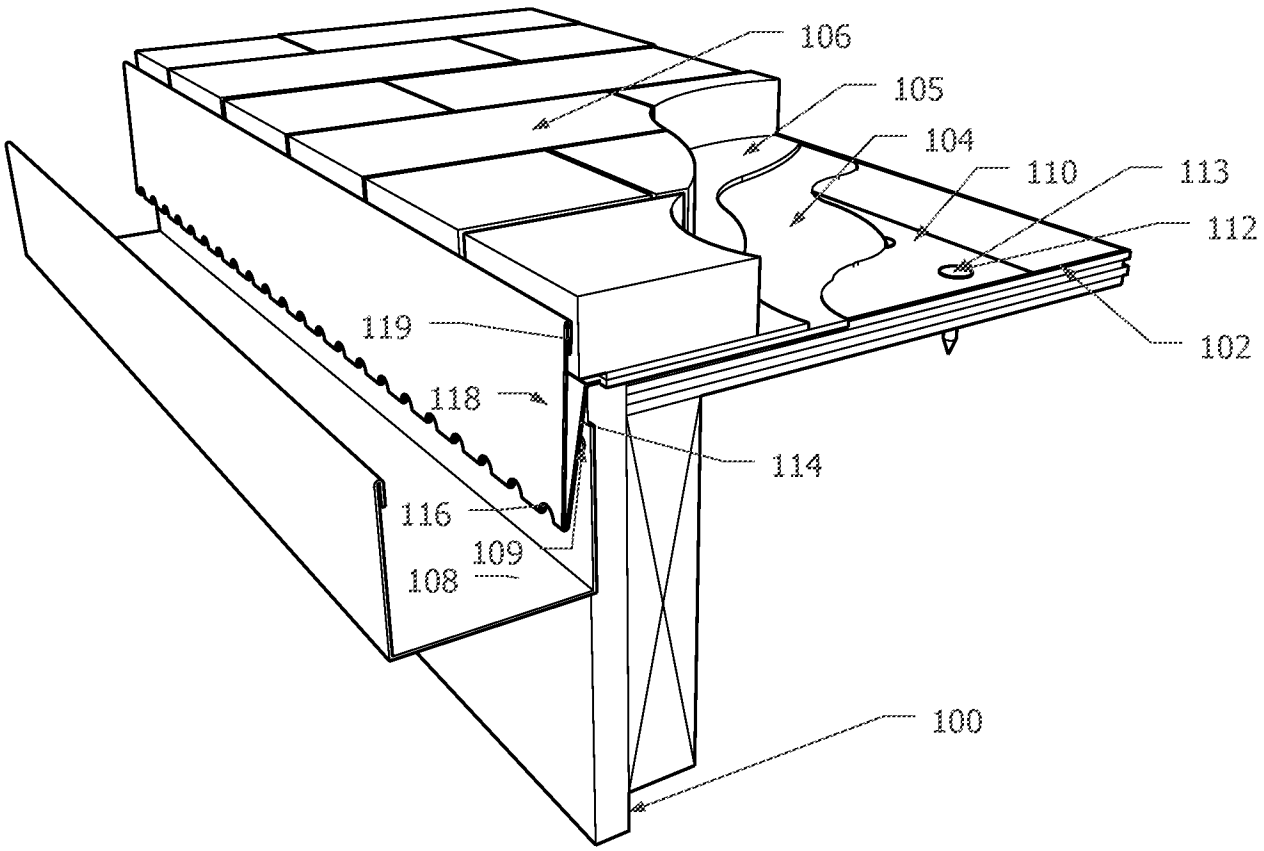
FIG. 1 is a perspective view of an exemplary flashing edging with a V-shaped trough at its edge provided on a flat roof having a gutter according to exemplary embodiments of the present disclosure.

In some embodiments, the flashing can direct water flow so that a gutter system can be installed underneath it, thus hiding and protecting penetrating mechanical gutter fasteners. Unlike conventional flashing, the inventive flashing does not have to be installed with a horizontal leg overhanging the edge of the roof so as to deposit water away from the inner edge of the gutter and penetrating mechanical fasteners. This is due to the angle not necessarily being 90 degrees at the junction point of the first and second planar portions of exemplary flashing, as shown in FIG. 1, where planar downward portion 114 makes an angle greater than 90 degrees with the horizontal planar portion 110. In preferred embodiments, as here, it can be larger than 90 degrees. It is noted that if such angle is 90 degrees then the horizontal leg would have to overhang the edge of the roof to allow space (say >¼") for gutter fasteners to be applied into the fascia board and so that water could freely drip from flashing into the gutter (avoiding capillary action on the inside of the second leg). However, if the angle is more than 90 degrees the above problems are avoided by the fact that the second leg (114) travels away from the roof edge and fascia board as it goes downwards.

In exemplary embodiments of the present disclosure, the flashing has flexibility as edging, making the installation of surface material easier and more aesthetically pleasing. This flexibility is especially important when the roof is not perfectly square in relation to the installed surface material. For example, as shown in FIGS. 1-18, making the flashing from a flexible material, such as metal, for example, allows it to have some give at the junction points. In such a case it is important to note that the point where the top of the edging (hem) of these embodiments meets the installed surface material contact can be maintained despite varying amounts of pressure, and the actual horizontal offset away from the roof of the hemmed upper portion of an outer leg of the flashing can vary. It is also noted that in embodiments such as those shown in FIGS. 1-12, where there is no integrated gutter, there is an added range of flexibility in that the flashing in these embodiments can overhang the roof edge to a varying extent without it being appreciably noticeable, inasmuch as the flashing is hidden from view to a degree by the gutter, surface material and guard rail (if applicable).

With a temporary tape, debris can be kept out of a V-shaped trough before installation of any surface material on the roof. It is even possible to pour a concrete surface over the roof without filling up the V-shaped trough when using a reinforced, yet tearable or bio-degradable tape with the flashing. In such instances, the top of the outer edging can be used as a screed surface. After the concrete has cured, the tape can either be torn or biodegrade, allowing water to drain into the V-shaped trough of exemplary flashing.

In exemplary embodiments of the present disclosure, the flashing can create a decorative edge which hides a lower edge of the installed surface material, any under structure, or drainage system for the installed surface material and roofing membrane.

In exemplary embodiments of the present disclosure, flashing may comprise only one piece, making it easier to install and less expensive to manufacture.

In what follows, two types of exemplary embodiments of novel flashing will be described. A first type of embodiment, which is depicted in FIGS. 1-12, is assumed to not perform the functions of a gutter, and thus, should those functions be desired, a separate gutter may be added to a given roof or deck provided with the exemplary flashing, as shown in FIG. 1. In contrast, the exemplary embodiments of FIGS. 13-31 integrate the functions of a gutter with those of the flashing in an integrated device, and thus no separate gutter is required, and consequently, no need to penetrate the fascia with nails, screws or attachment devices.

I. Flashing Embodiments for Use With Separate Gutters

A. FIGS. 1-3

Figure 2:
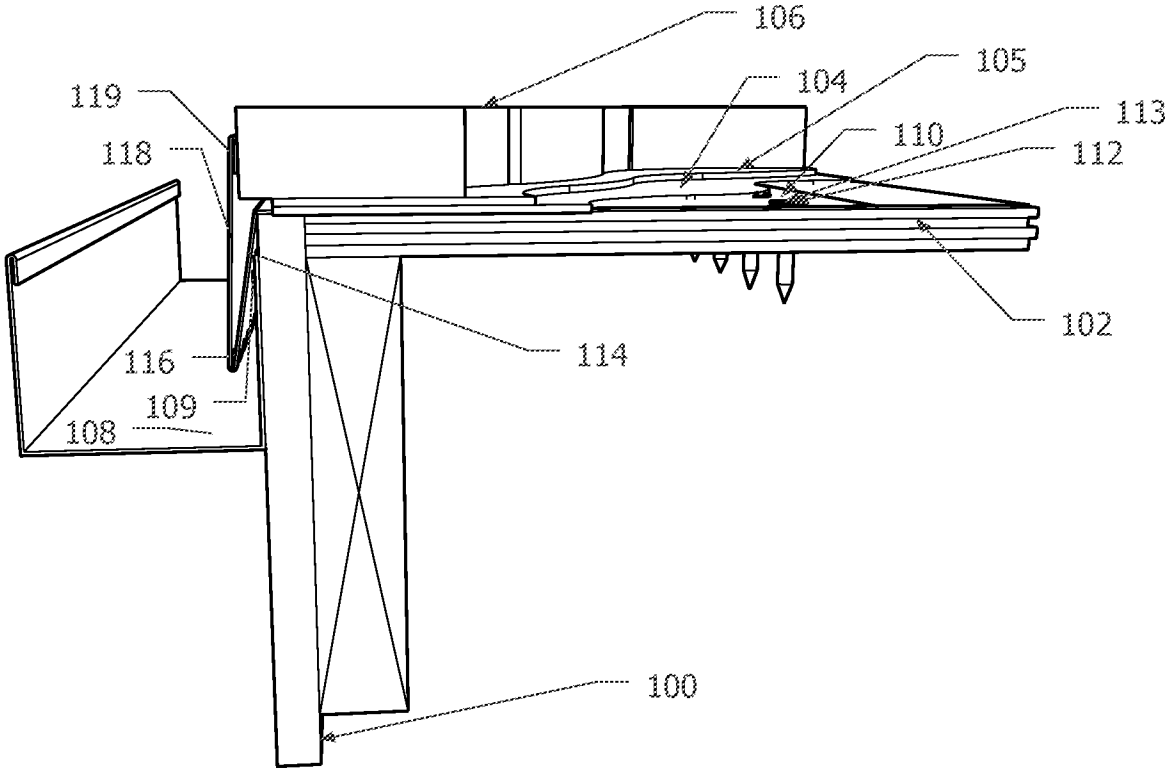
FIG. 2 depicts a side view of the exemplary flashing edging as shown in FIG. 1; as seen by an observer facing the end of a roof or deck.
Figure 3:
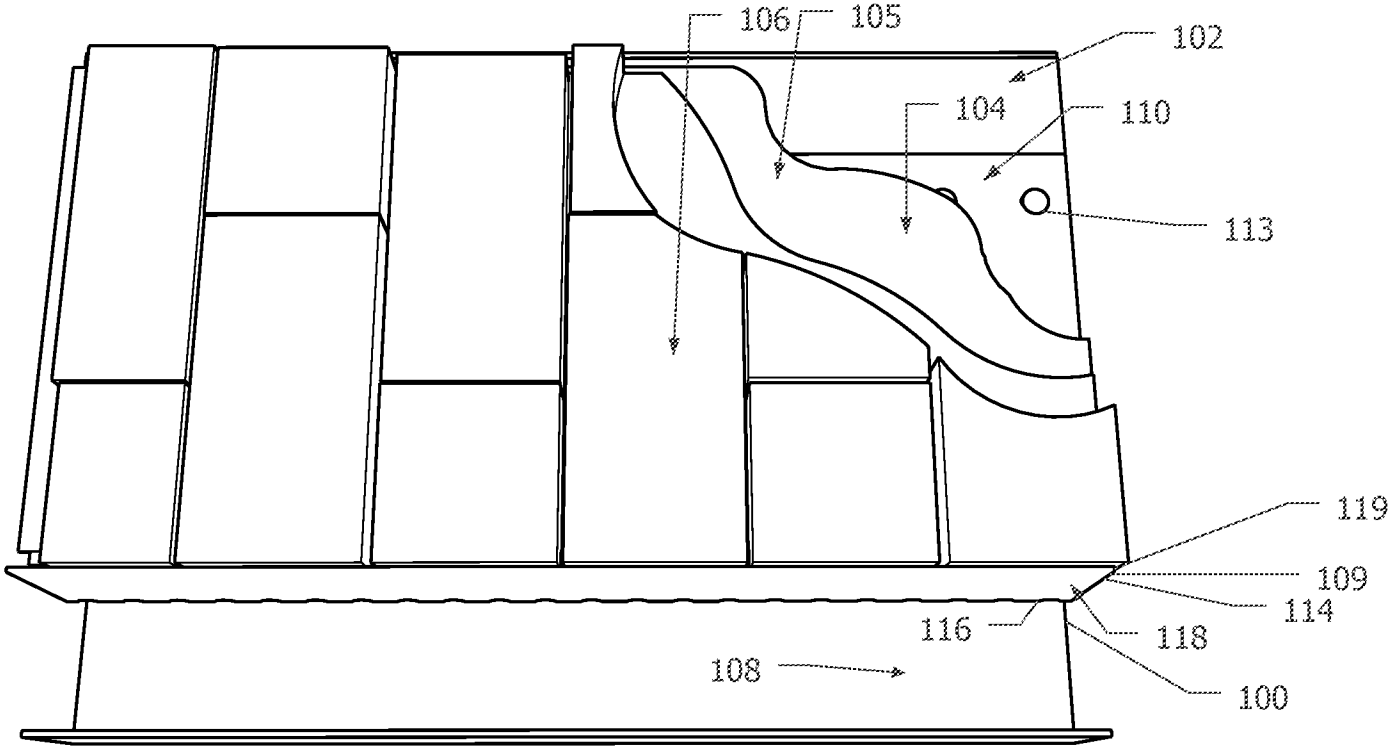
FIG. 3 depicts a top view of the exemplary flashing edging as shown in FIG. 1, as seen by an observer looking down on a roof or deck from above.

FIGS. 1-3 (perspective, side and top views, as above) show an exemplary flashing edging with a V-shaped trough at its edge provided on a flat roof having a gutter according to exemplary embodiments of the present disclosure;

With reference to FIGS. 1-3, the flashing edging has a horizontal leg 110 that lays flat along an exemplary rooftop. The flashing may be fastened with mechanical fasteners 113 to a substrate 102 via various holes 112 provided in the horizontal leg 110 and which are located near a rear, or inward, edge of said horizontal leg 110. Alternatively, any appropriate construction adhesive may be used to adhere the horizontal leg to substrate 102. A roofing membrane or material 104 in this embodiment may be adhered over the top of the flashing 110 using an appropriate adhesive, extending to the roof edge. An extra piece of membrane 105 can be installed over the entire roof, and a surface material 106, such as pavers may be installed over the roof, the horizontal flashing leg, and the roofing membranes 104, 105.

Thus, in the exemplary embodiment of FIGS. 1-3, when installing roofing membrane 104 and any extra membrane 105, the edge flashing is first installed, as shown. Continuing with reference to FIG. 1, from the edge of the roof the flashing has an inside leg 114 that protrudes downward and away from the roof edge, and at a defined acute angle from the vertical plane of the roof edge. A final outer leg 118 comes up from the bottom of leg 114 at a slight inward cant. Located on the top inside face of outside vertical leg 118 is a hem 119 that abuts installed surface material 106, which can be, for example, pavers. Inside leg 114 and outside vertical leg 118 may form a V-shaped trough, as shown. Either on the bottom bend of the V-shaped trough, or near the bottom of inside leg 114 (and therefore more hidden from view) there may be provided a series of holes 116 through which water may flow. Located under the trough can be, for example, a water collection device such as gutter 108 which is attached to what is often a fascia board 100 via mechanical fasteners 109.

Thus, the exemplary flashing as illustrated in FIGS. 1-3 is an edging/border retainer that provides a passage for water to drain off of a flat roof Referring to FIGS. 1 and 3, horizontal leg 110 of the exemplary flashing is attached to the roof underneath surface material 106, which in turn augments the solidity and longevity of the installation. As noted, vertical outside leg 118 can have a slight cant inward/roofward (i.e., being a plane having an angle off of the vertical plane parallel to the edge of said surface material 106) to allow for varying pressure from installed abutting surface material 106. A V-shaped trough formed from inside leg 114 angled down and away from the roof edge and the outside vertical leg 118 allows water to travel down and away from (i) roofing membranes 104 and 105; (ii) bottom of the surface material 106; and (iii) fascia board 100. Holes 116 may be located on the bend or bottom of this V-shaped trough or hidden along the bottom of inside leg 114, allowing water to drain out of the V-shaped trough. In this embodiment, a water collection device—such as gutter 108—may often be installed underneath the flashing. If water comes off of surface material 106 and travels down the outside of vertical outside leg 118, as may be the case with heavier rain, the outside of the bottom of the V-shaped trough acts much like a drip edge dropping water into gutter 108.

As shown, surface material 106 slightly overhangs the roof edge above the opening of the V-shaped trough and butts into hem 119 on vertical leg 118 of the flashing. The distance of the overhang of surface material 106 should be no greater than that which would ensure that said surface material 106 would remain stable. Most flat roofs require a guard rail. In this connection it is noted that the International Residential Code requires a guard rail if a roof or deck is higher than 32" off of the ground. This impedes foot traffic along the perimeter edge of the roof where surface material 106 hangs over the roof edge. Due to its abutment of hem 119, surface material 106 provides protection from unwanted debris entering the V-shaped trough.

In exemplary embodiments of the present disclosure, exemplary flashing can be installed so that the juncture of horizontal leg 110 attached to the roof and inside leg 114 is located at the edge of the roof, while still channeling water away from the inner edge of gutter 108. This is because leg 114 travels away from fascia 100, at a defined acute angle off of the vertical, and towards the outer edge of gutter 108 as it protrudes downward, as noted above. This allows water to flow into gutter 108 away from mechanical fastener penetrations 109 located on the inside of gutter 108 attaching the gutter to fascia 100. In such cases, the flashing serves the dual purpose of both hiding penetrating gutter fasteners 109 and protecting them from weather. These penetrations need to be protected from water to avoid rotting fascia board 100 which generally results in the eventual failure of fasteners 109.

B. Additional Embodiments of FIGS. 4-12

FIGS. 4-12 each show a variation of the exemplary flashing shown in FIGS. 1-3 where the analog of outer leg 118 (of FIGS. 1-3) angles back towards, and serves as edging for, the abutting installed surface material. This allows the surface material to be installed so that its outer face is either flush or set back from the roof edge by some length.

Figure 4:
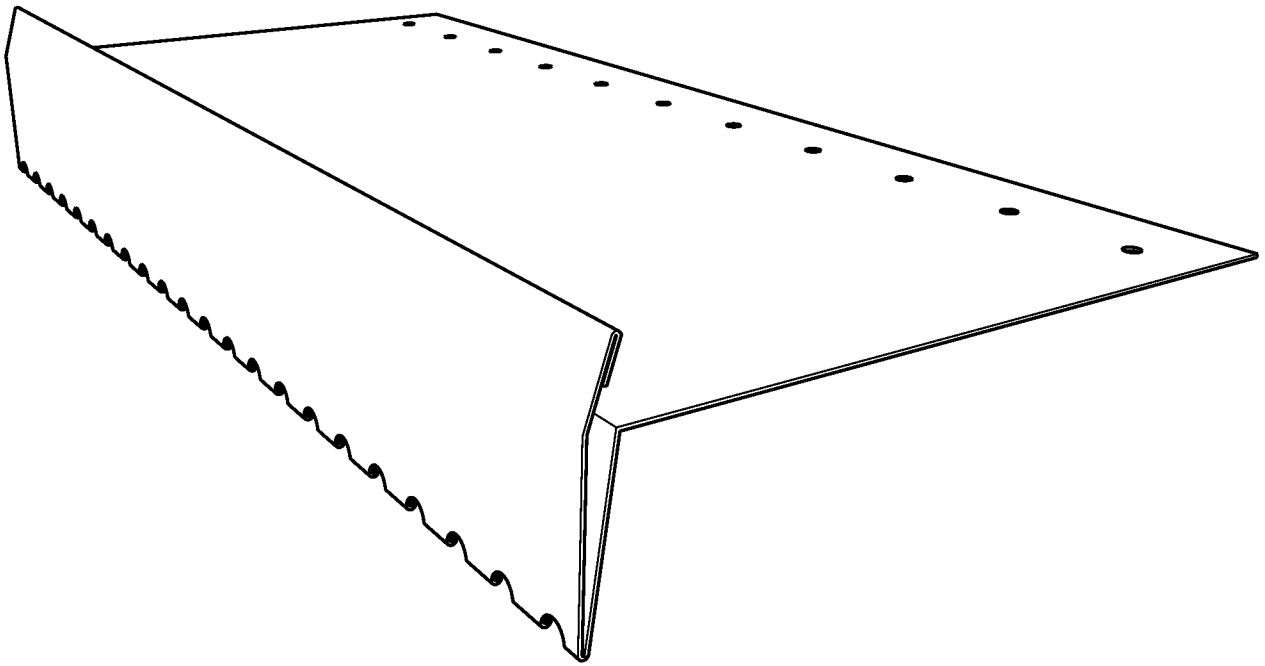
FIGS. 4-6 depict exemplary flashing where a portion of the outer leg is offset from the roof edge.
Figure 5:
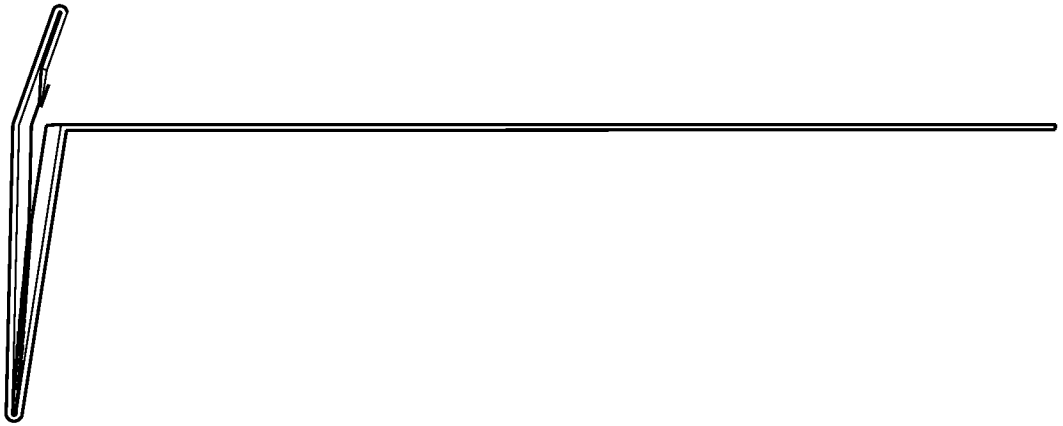
Figure 6:
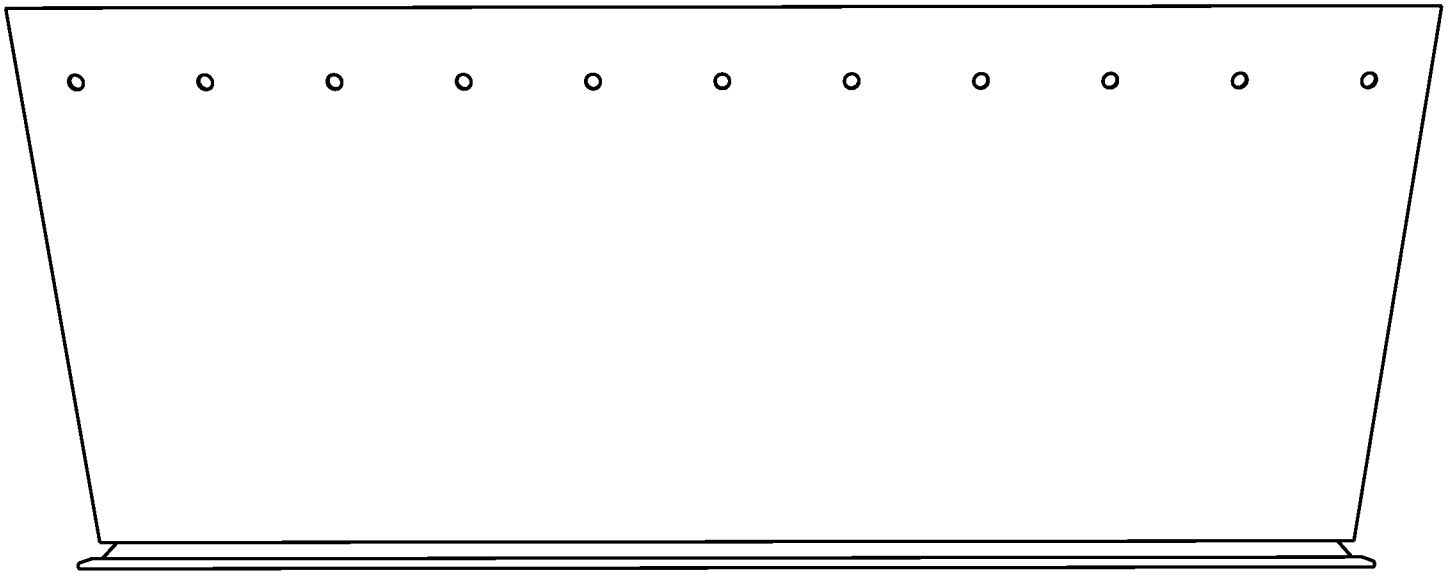

With reference thereto, FIGS. 4-6 depict an exemplary flashing where the upper portion of outer vertical leg 118 is bent back towards the roof, and crosses the vertical plane of the roof edge and protrudes roofward even beyond said plane at the top of said vertical leg. This is shown, for example, in FIG. 4, and it can accommodate, as noted, the case where the surface material does not extend to the edge of the roof.

Figure 7:
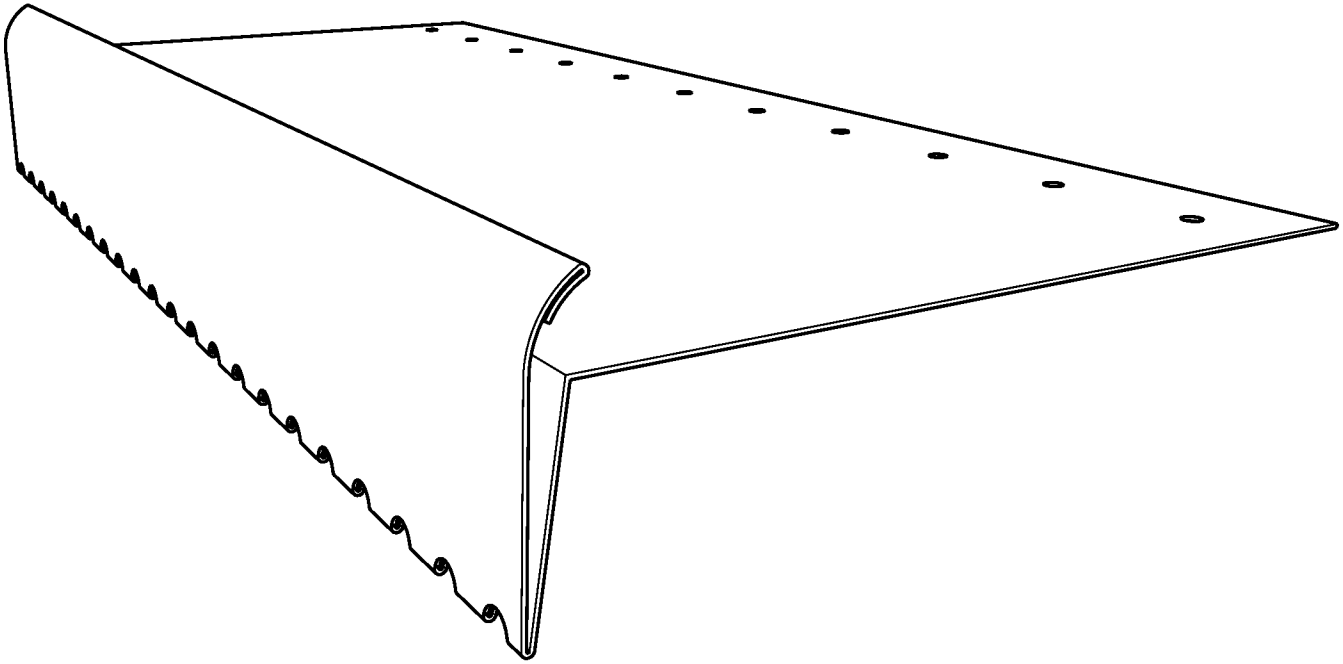
FIGS. 7-9 depict exemplary flashing where the outer leg is offset from the roof edge and has a rounded upper portion at the top of the outer vertical leg.
Figure 8:
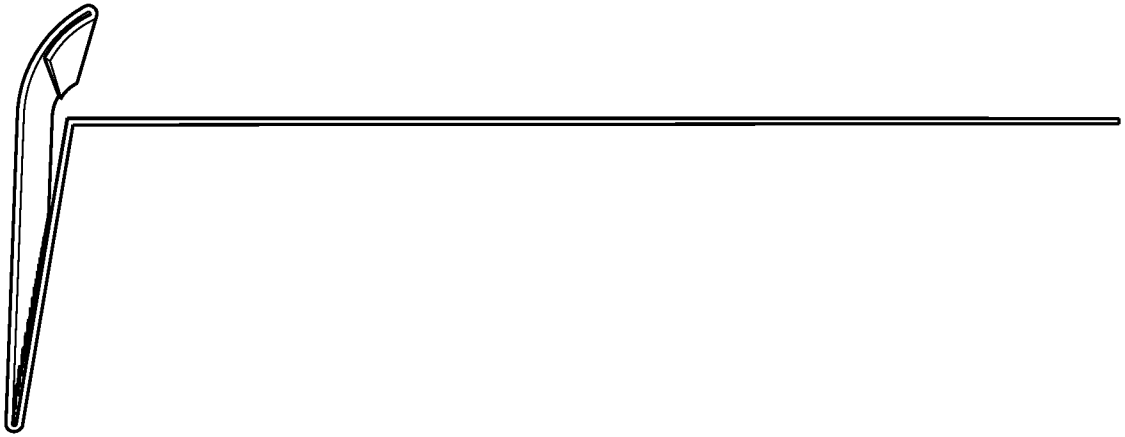
Figure 9:
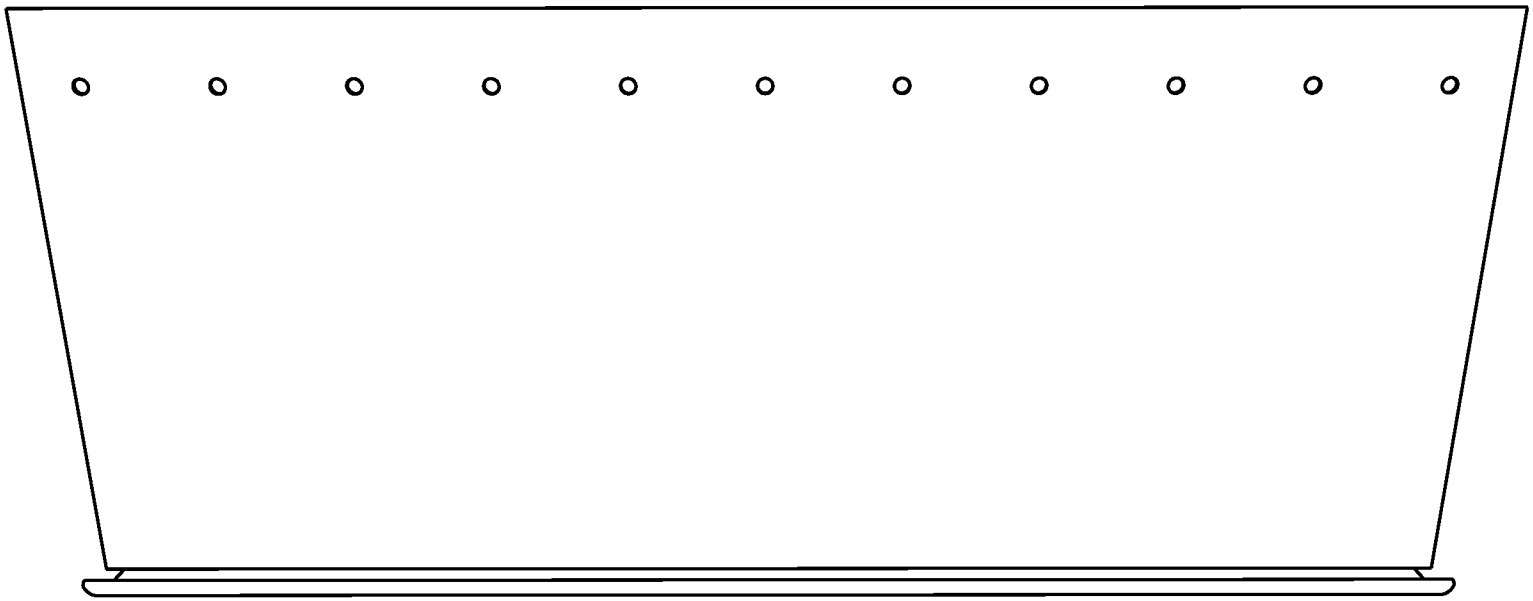

Similarly, the exemplary flashing of FIGS. 7-9 has a similar function as that of FIGS. 4-6, but here the upper portion of vertical leg 118 has a gradual curve back towards the roof, as opposed to a bend separating two planes.

Figure 10:
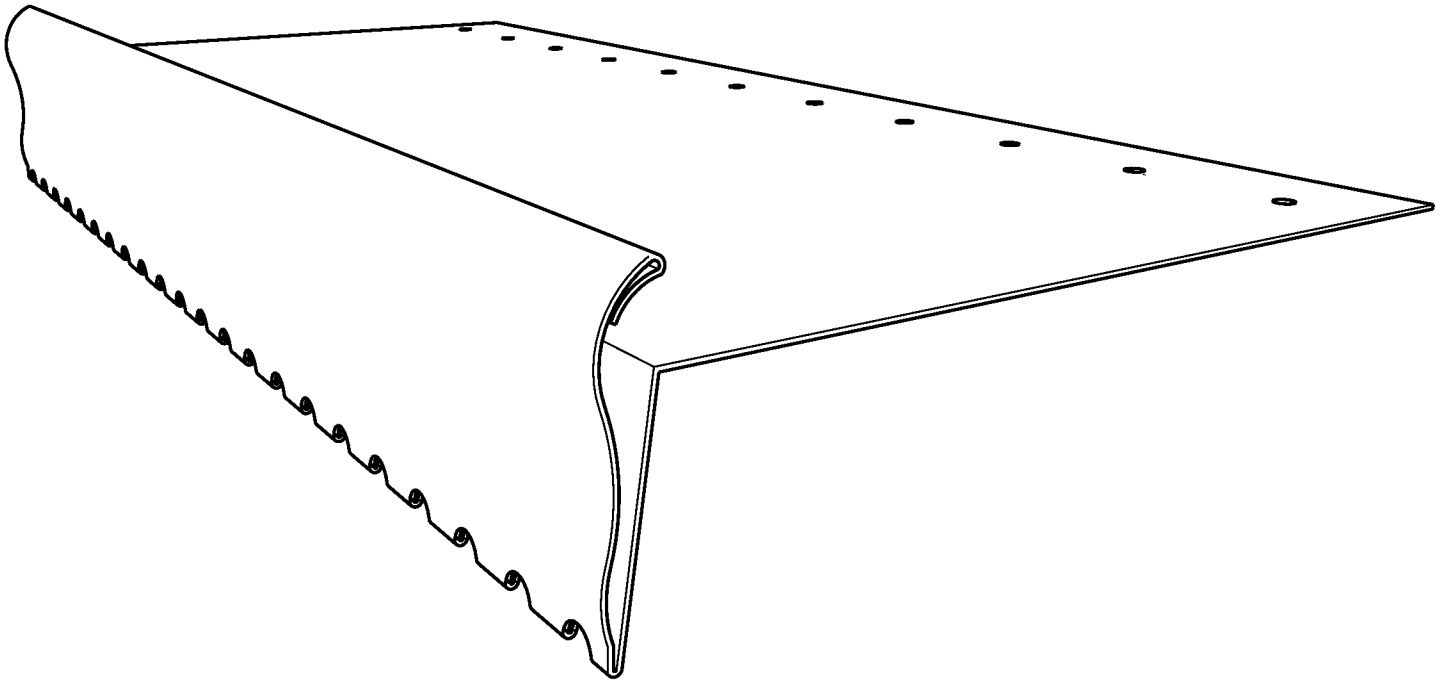
FIGS. 10-12 depict 3 where the outer leg is offset from the roof edge and the entire outer leg has a wavy shape and has a rounded upper portion at the top of the outer vertical leg.
Figure 11:
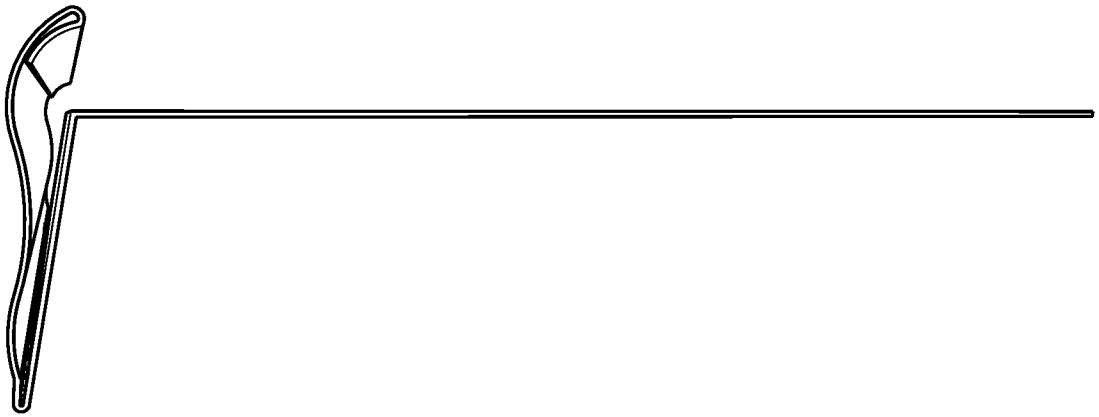
Figure 12:
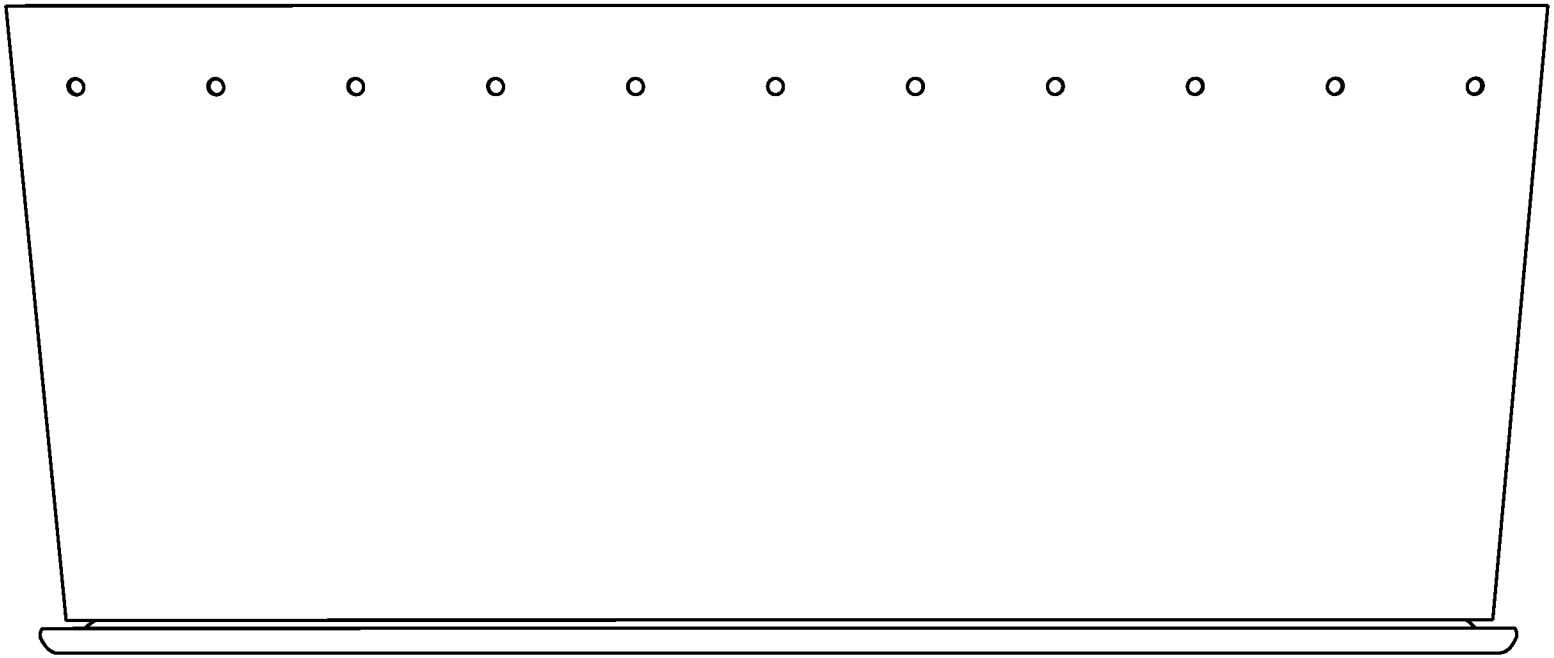

Finally, FIGS. 10-12 depict a further variation of FIGS. 7-9, where in this alternate embodiment, the vertical leg 118 has a wavy shape, but still has the same curve-back towards the roof feature of the flashing as shown in FIGS. 7-9.

II. Embodiments Having Integrated Flashing and Gutter Functionality

FIGS. 2 through 5, next described, depict an alternate type of exemplary embodiment, where the flashing incorporates its own gutter, obviating the need to have a separate gutter. This eliminates the need to penetrate into the fascia 100 (referring to FIG. 2), as the gutter portion is supported by the attachment of the exemplary flashing to the roof, and held there by the weight of the surface material 106.

FIG. 2 show another alternate exemplary embodiment of flashing edging, provided with a cylindrical front leg that creates its own gutter-like trough.

With reference thereto, horizontal leg 110 of the flashing is laid flat along the roof top. In this exemplary embodiment, it is fastened to substrate 102 via holes 112 located along the inward edge of the flashing. An appropriate construction adhesive may be used to adhere horizontal leg 110 to the roof deck 102 as well. Roofing membrane 104 may be adhered over the top of the flashing using an appropriate adhesive extending to the roof edge. An extra piece of membrane may also be installed over the entire roof 105. A surface material 106 may then be installed over roof, horizontal leg of flashing 110, and roofing membranes 104 and 105.

As shown from the edge of the roof, curved leg 214 protrudes downward and then comes up and curves back towards the roof to meet and abut against surface material 106 at hemmed edge 219.

It is noted that the hem on hemmed edge 219 is a preferred component, commonly used in edging but it is not crucial. The advantages of having a hem facing the inside face of the portion of the flashing that contacts the installed surface material are the following: (1) it stiffens/strengthens the flashing so that it is less likely to bend during installation; (2) it stiffens/strengthens the flashing edge so that the edge remains more consistent versus wavy if the pressure of the abutting installed surface material varies; and (3) having the hem face towards and contacting the abutting installed surface material there is an added amount of variance where the top of the flashing will retain contact with the installed surface material even if the top edge of the flashing is slightly pitched away from the surface material (instead of parallel or slightly inwards).

Thus, the exemplary flashing illustrated in FIG. 2 serves as both an edging/border retainer and a gutter-like water management device in one.

Horizontal leg of flashing 110 can thus be attached to the roof, underneath installed surface material 106, which in turn augments the solidity and longevity of the installation. In this exemplary embodiment, the surface material can overhang, be flush, or be set back from the edge of the roof. Surface material 106 also acts like a gutter guard to keep debris such as leaves from entering the curved trough formed by curved leg 214, which is rigid yet flexible enough to allow for varying pressure from an installed abutting surface material 106. Water can drain from the roof into the curved trough. The exemplary flashing can be made so that it is compatible with standard market gutter outlets for round downspouts.

Figure 13:
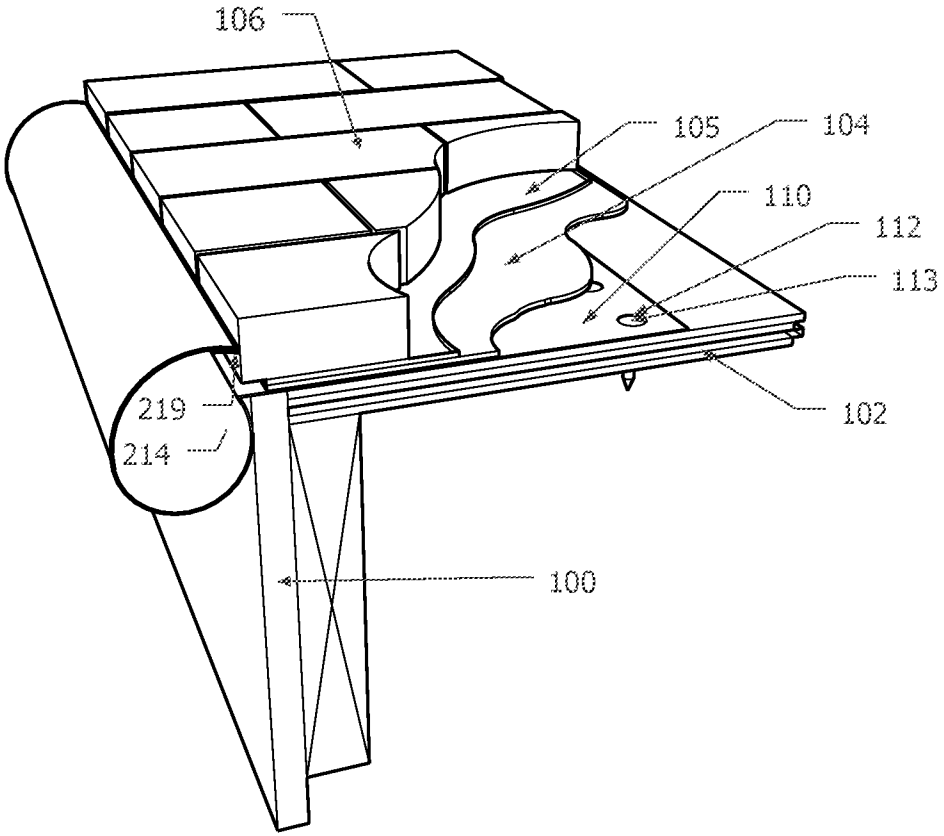
FIGS. 13-15 depict exemplary flashing where the outer leg forms a cylindrical shape.
Figure 14:
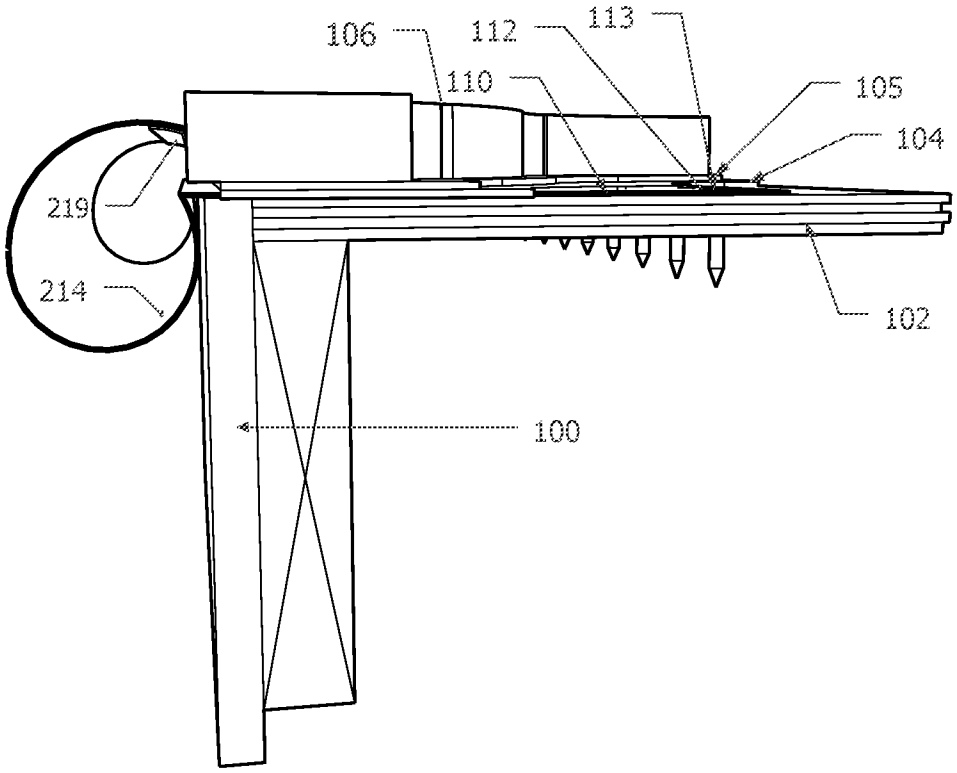
Figure 15:
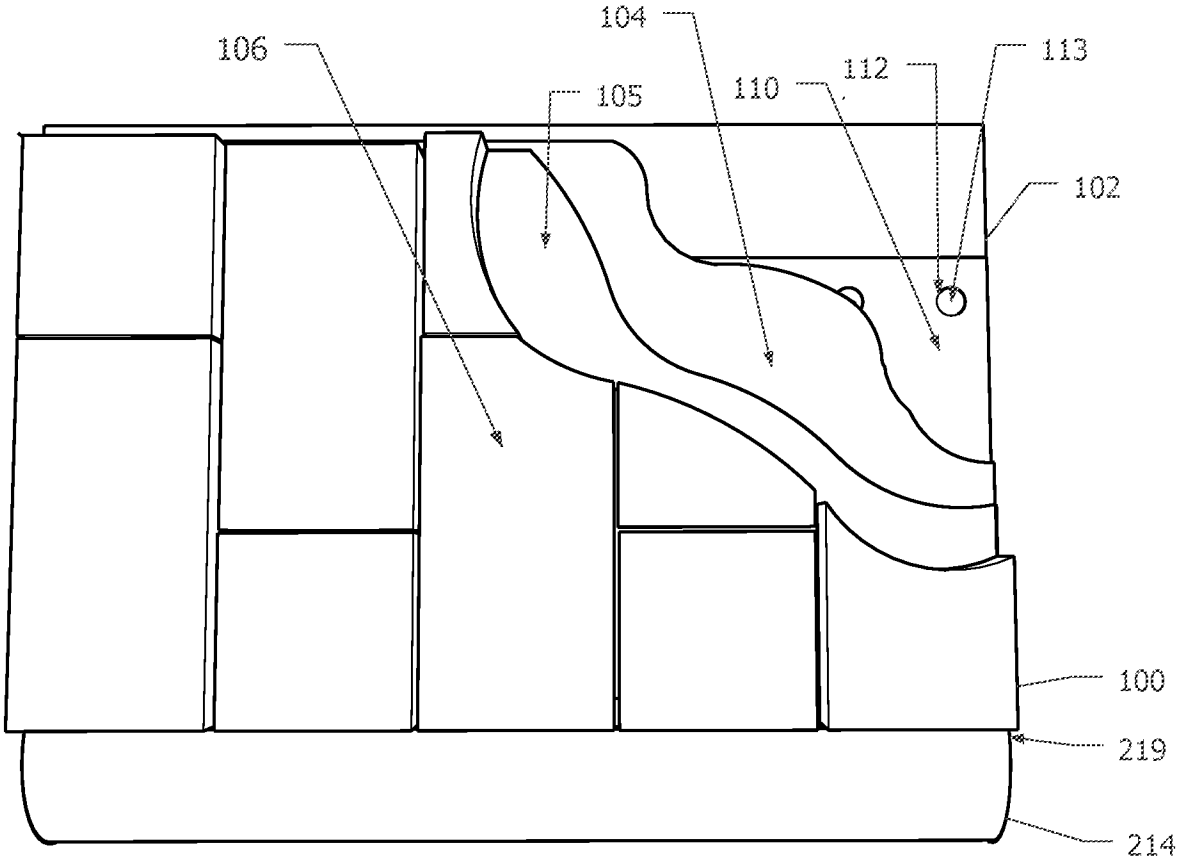
Figure 15A:
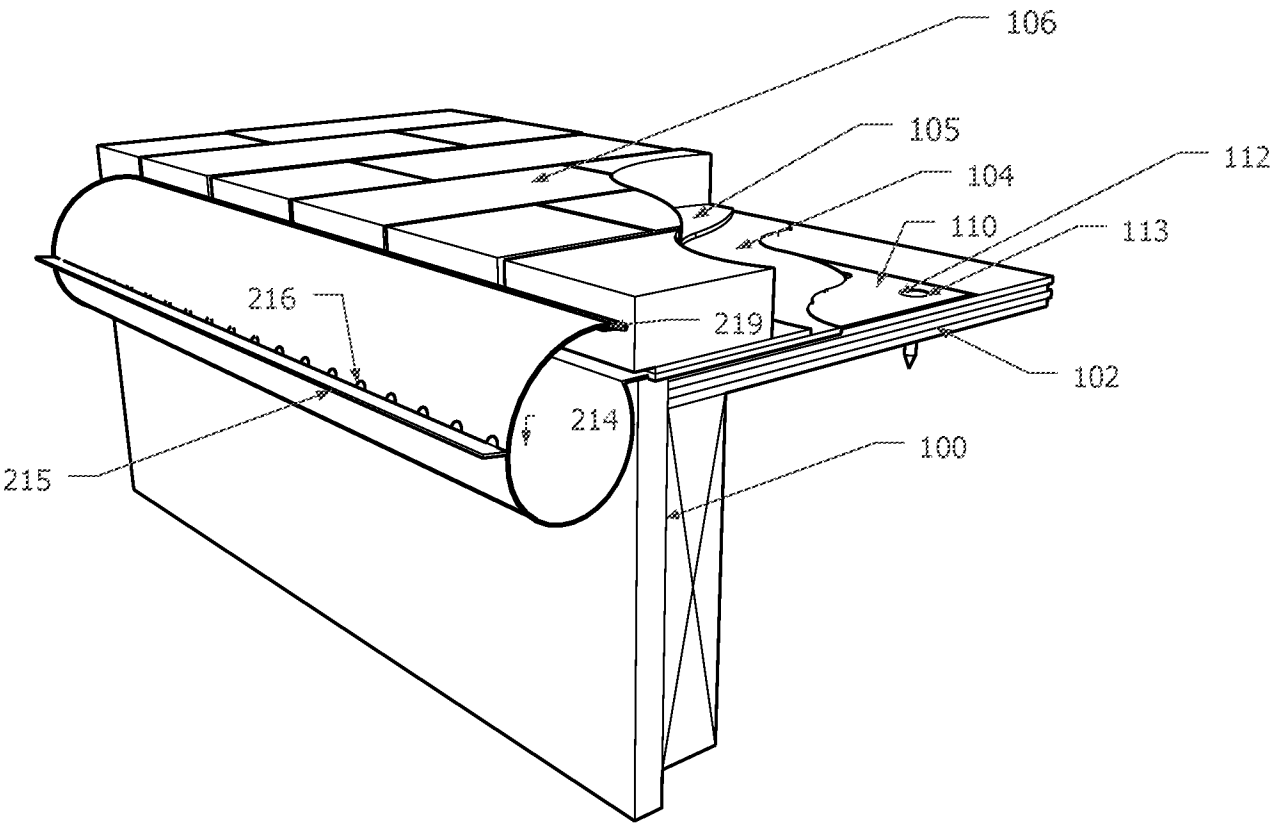
FIG. 15A shows a variant of the alternate exemplary embodiment of FIG. 13, with an additional fin (215) provided on the outer edge of the cylindrical front leg of the flashing, to catch water runoff along that outer edge.

FIG. 15A shows a variant of the alternate exemplary embodiment of FIGS. 13-15, with an additional fin provided on the outer edge of the cylindrical front leg of the flashing, to catch water runoff along that outer edge. This additional feature may also be added to the flashing variations shown in each of FIGS. 19-24, described below, as well. In general, such a fin can, for example, be attached to the outside or forward vertical (or substantially vertical, for a curved embodiment) edge to catch water that flowed off of the installed surface material onto the outside of the flashing. For example, as shown in in FIG. 15A, holes, like scuppers, located along the fin allow water to flow back into the trough instead of dropping on the ground.

Figure 16:
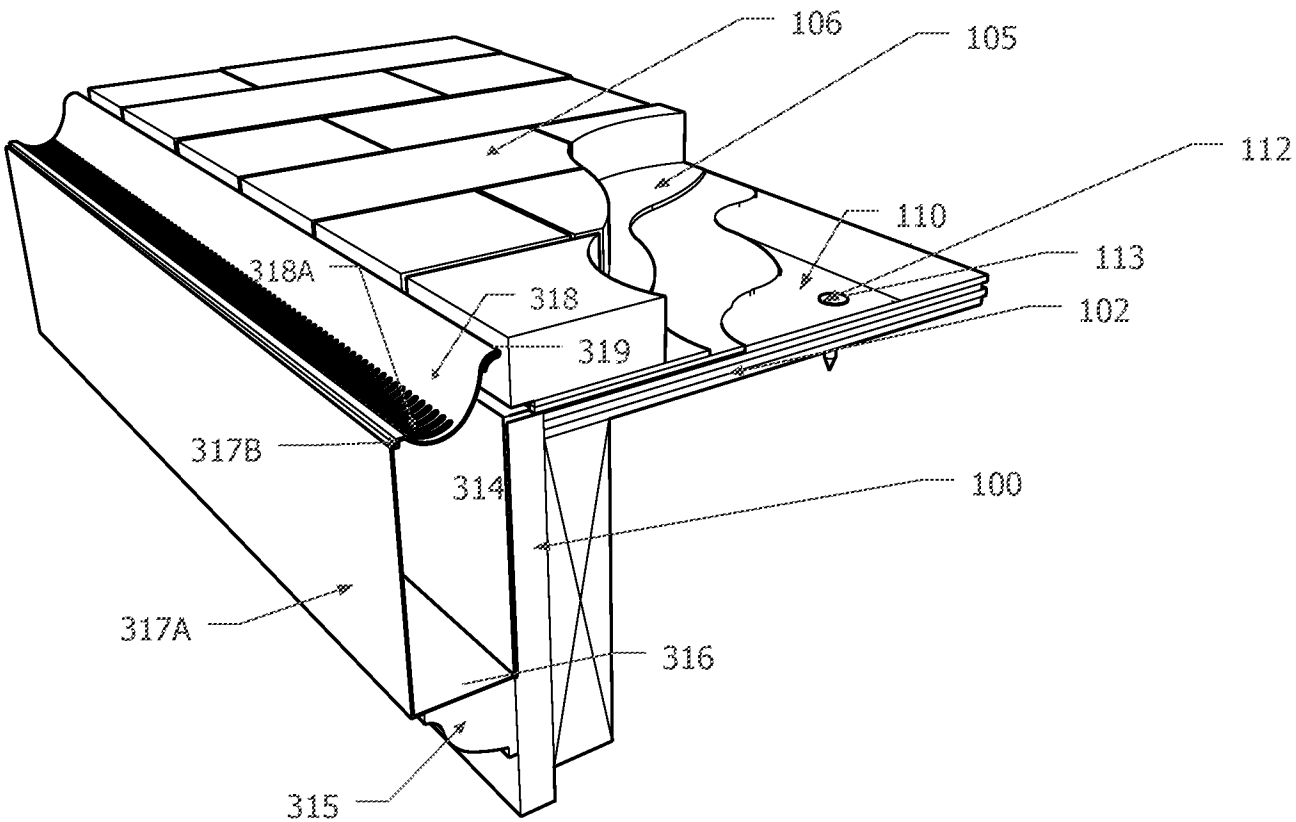
FIGS. 16-18 depict exemplary flashing where the outer leg forms an integrated gutter.
Figure 17:
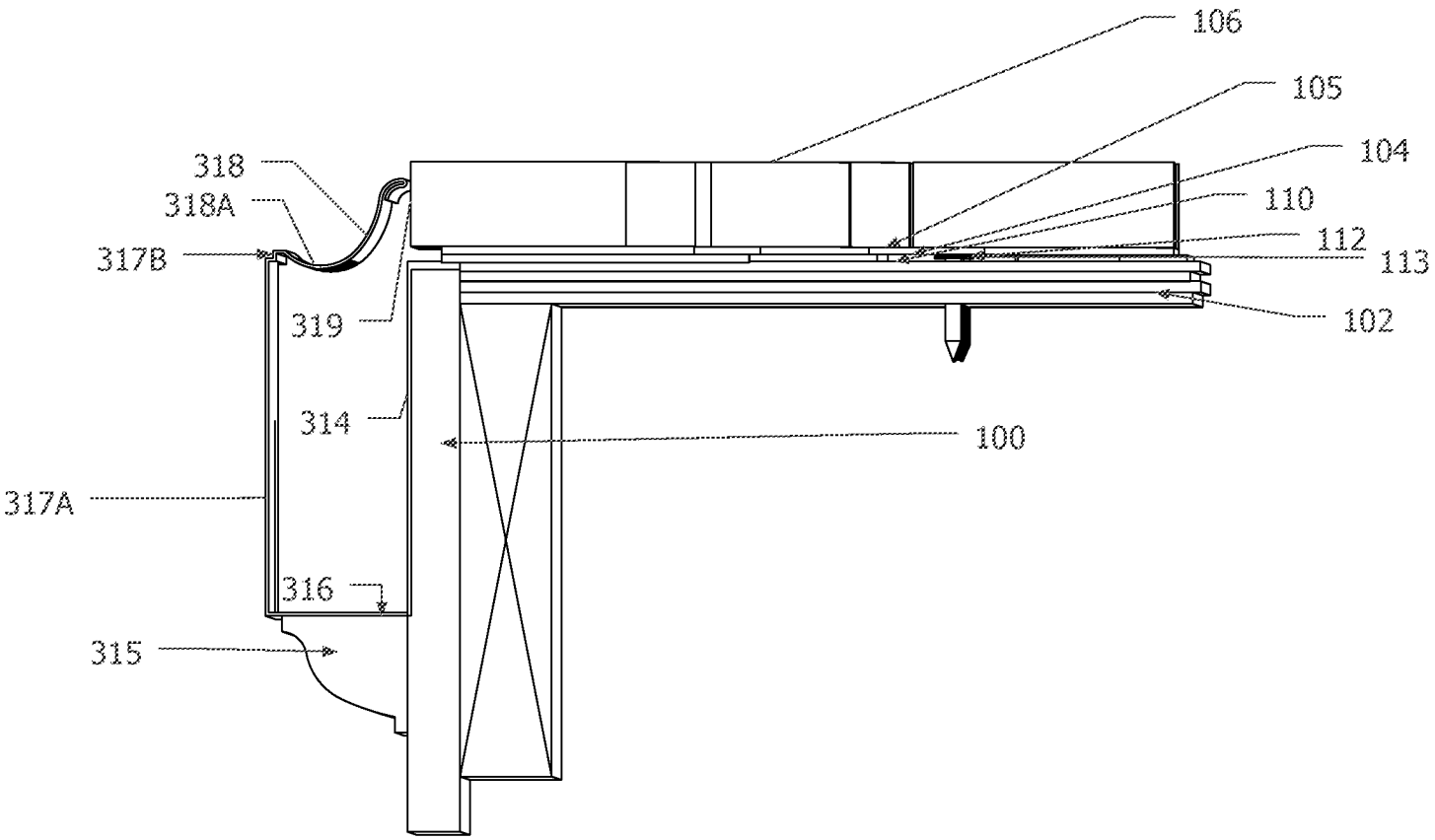
Figure 18:
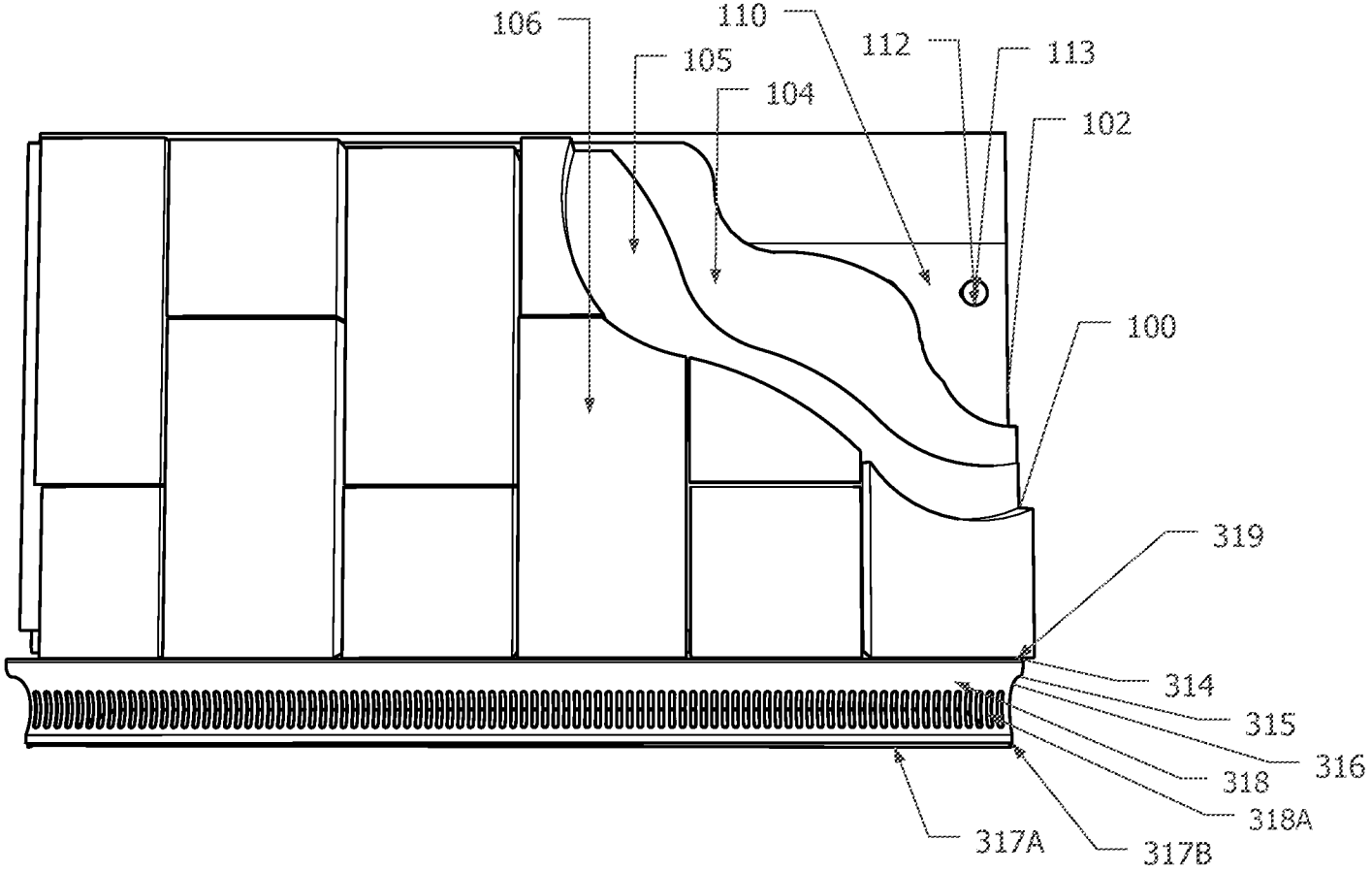

FIGS. 16-18 depict an alternate exemplary edging flashing that has a flatter profile on the vertical plane and forms a rectangular trough. Thus, horizontal leg 110 of the flashing is laid flat along the roof top. As noted, it may be fastened to substrate 102 via holes 112 located along the inward edge of the flashing. Alternatively, an appropriate construction adhesive may be used to adhere this leg to the roof deck as well. Roofing membrane 104 can be adhered over the top of the flashing using the appropriate adhesive extending to the roof edge. An extra piece of membrane can also be installed over the entire roof 105, for example. A surface material 106—a rectangular brick or simulated rectangular brick type roof covering—is here shown installed over the roof, horizontal leg of flashing 110, and roofing membranes 104 and 105.

From the edge of the roof, an inside vertical leg 314 of the flashing protrudes downward, transitioning to a flat horizontal bottom leg 316. In FIGS. 16-18, a decorative molding detail 315 can also be part of the flashing or, for example, installed underneath the flashing. An outside vertical leg 317A of the flashing goes up from the front edge of horizontal bottom leg 316 to a detail inset 317B, which is a recessed ledge feature. The top leg 318 of the flashing, which serves as a cover to the gutter created by legs 314, 316 and 317A, goes up and towards the installed surface material in a concave curve. A trough with perforations 318A may be located at the bottom of top leg 318. At the top of top leg 318 a top hem 319 abuts installed surface material 106.

Thus, the exemplary flashing illustrated in FIGS. 16-18 serves as both a decorative edging/border retainer and as a water management device, much like a gutter. Here horizontal leg 110 of the exemplary flashing is attached to the roof, underneath installed surface material 106, which in turn augments the solidity and longevity of the installation. In this embodiment as well, the installed surface material can overhang, be flush, or be set back from the edge of the roof. Surface material 106 can also act like a gutter guard to keep debris such as leaves from entering the trough formed by legs 314, 316, and 317 of the exemplary edge flashing. It is noted that detail inset 317B is an aesthetic architectural detail that may be added, but is not essential to the functionality.

Top leg 318 with hem 319 can be rigid yet flexible enough for some variation in pressure from an installed abutting surface material 106. Top leg 318 provides a water catch and passage via perforations 318A for water coming off of the top of surface material 106 when water flows on the outside of the edging during heavier rains.

This embodiment of FIGS. 16-18 illustrates how flashing can blend in and complement the fascia assembly, echoing details of commonly used wood moldings in decorative molding detail 315, which can provide additional support for the gutter portion of the flashing. This embodiment can, for example, be made to be compatible with standard downspout outlets.

Figure 19:
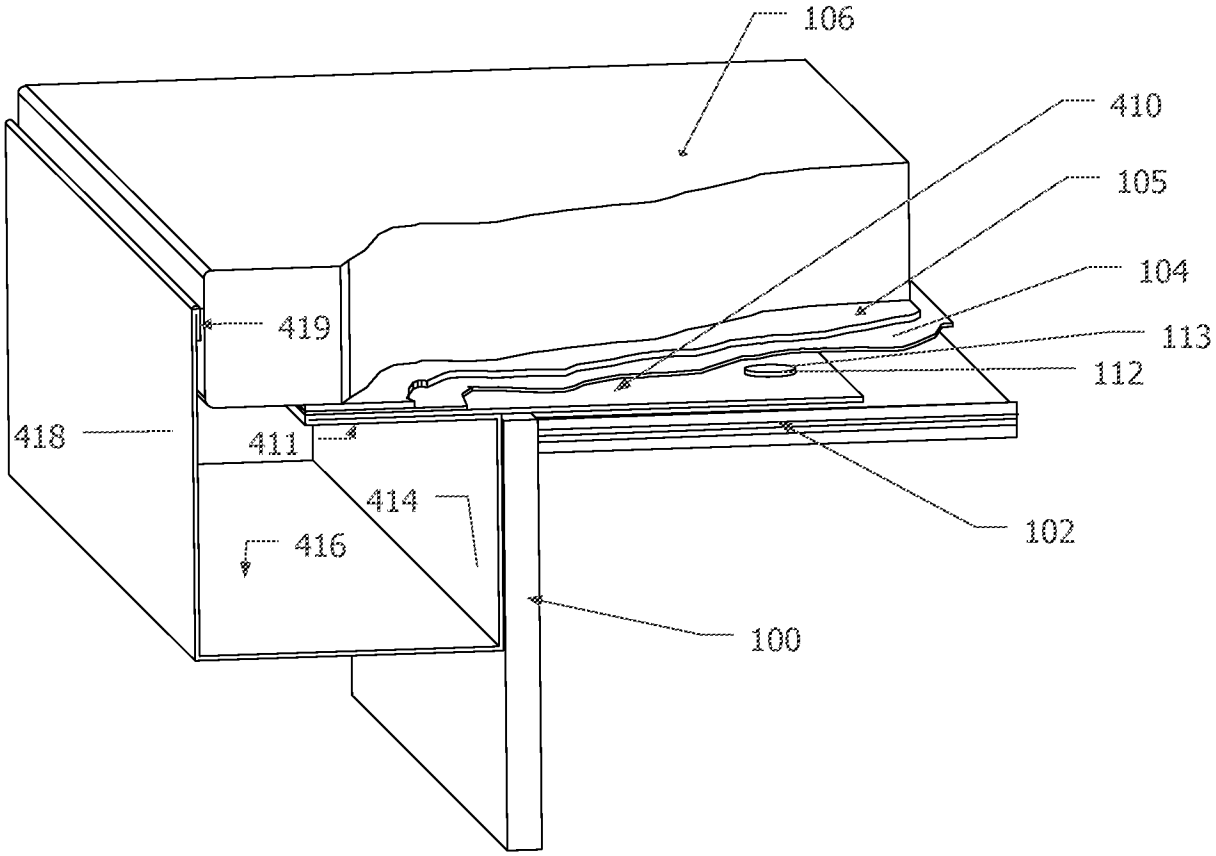
FIGS. 19-21 depict exemplary flashing where the outer leg forms an integrated gutter, and the horizontal portion of the flashing nearest the roof edge extends outward from, and beyond the roof edge, folds under itself, and creates a gutter structure; this allows the installed material 106 to actually extend beyond the actual roof edge, thus resting on a "cantilevered" horizontal portion of the edge flashing.
Figure 20:
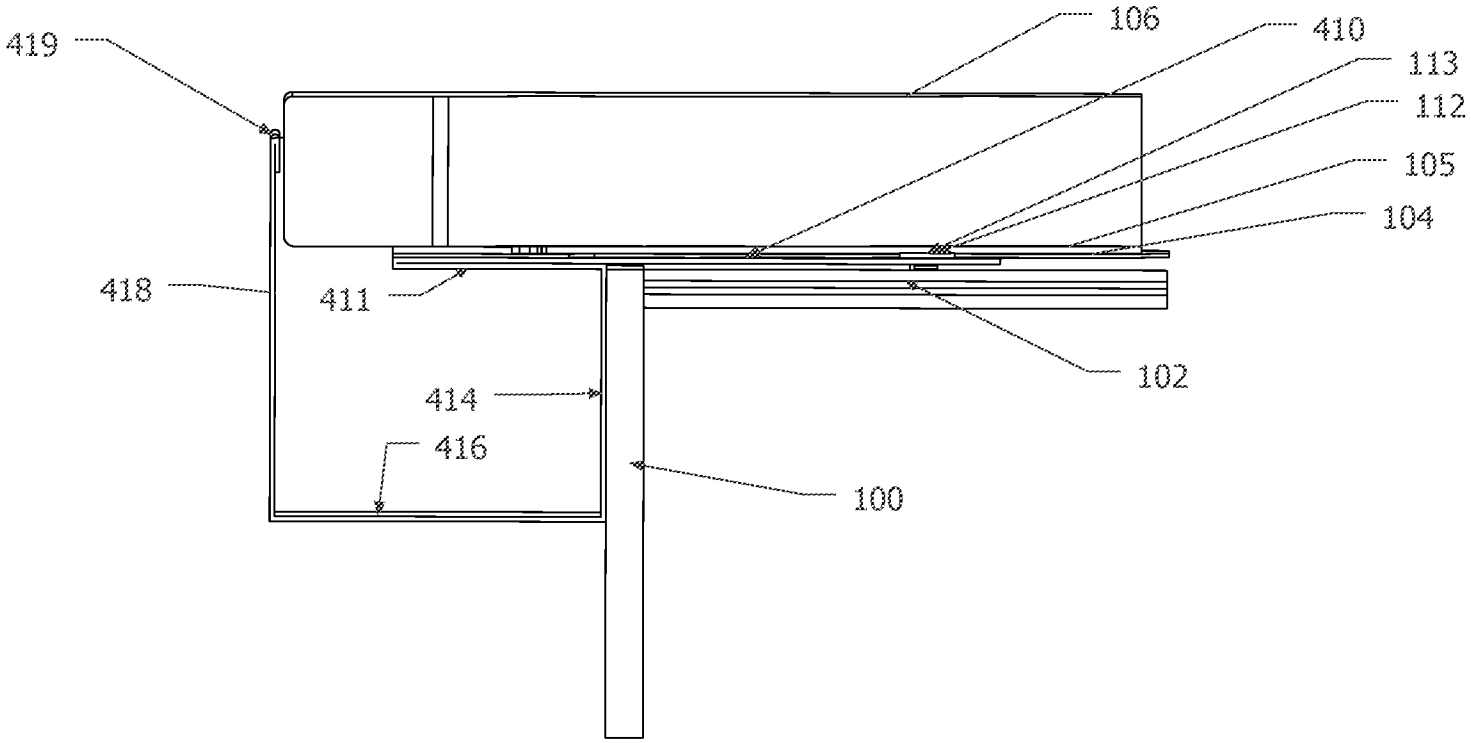
Figure 21:
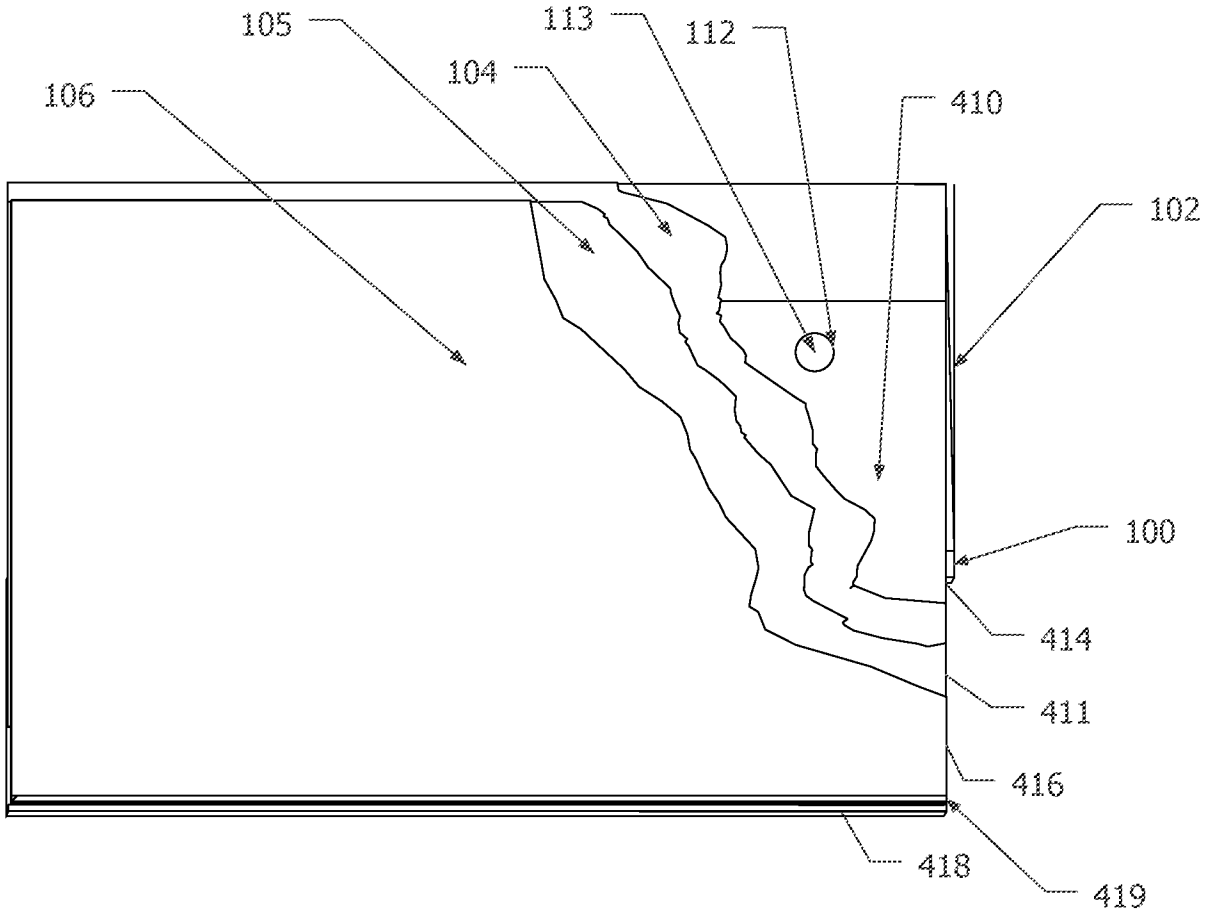
Figure 22:
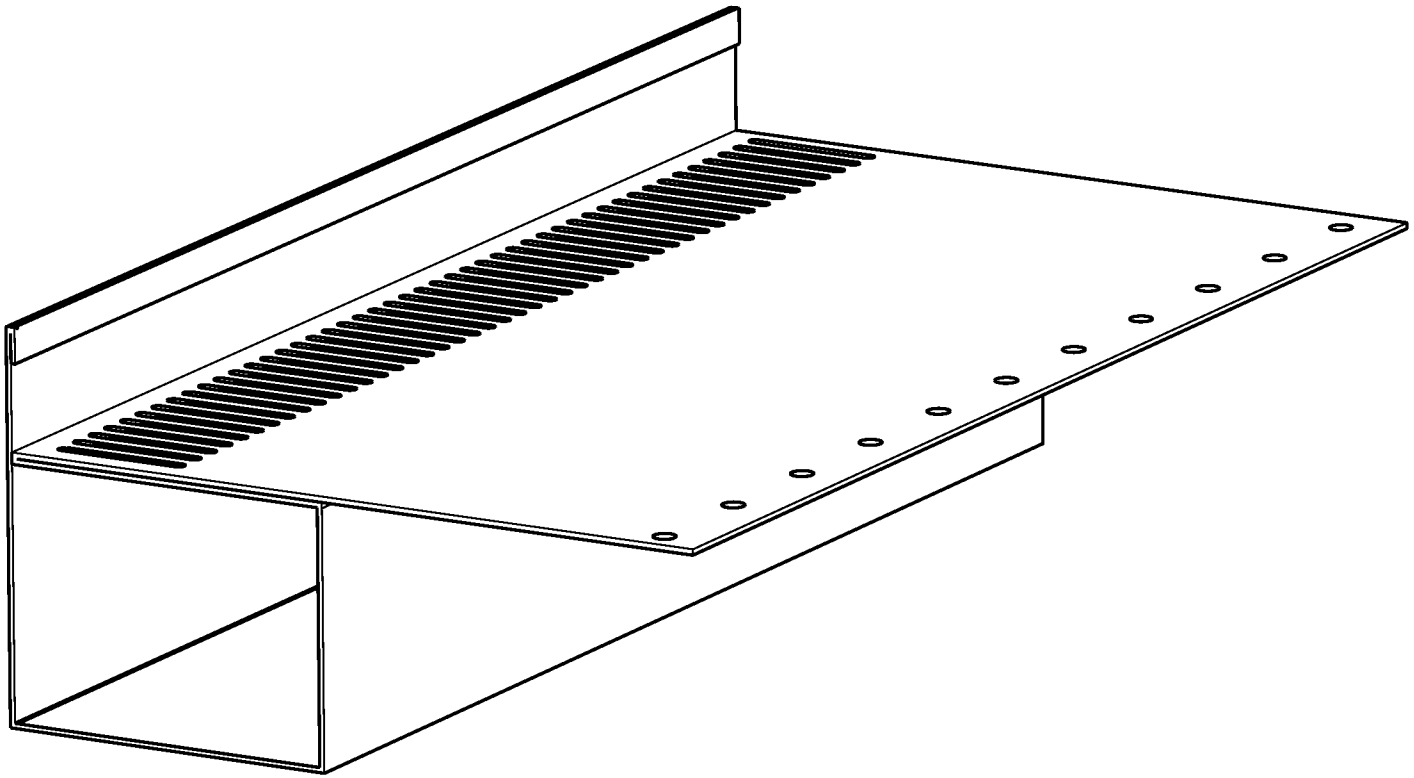
FIGS. 22-24 depict a variation of the exemplary flashing of FIGS. 19-21, where the horizontal portion of the flashing nearest the roof edge extends outward from, and beyond the roof edge all the way to the outer vertical leg, then folds back under itself to the roof edge, and creates a gutter structure; this allows the installed material 106 to actually extend beyond the actual roof edge, but now all the way to the outer leg, thus resting on a "cantilevered" horizontal portion of the edge flashing.
Figure 23:
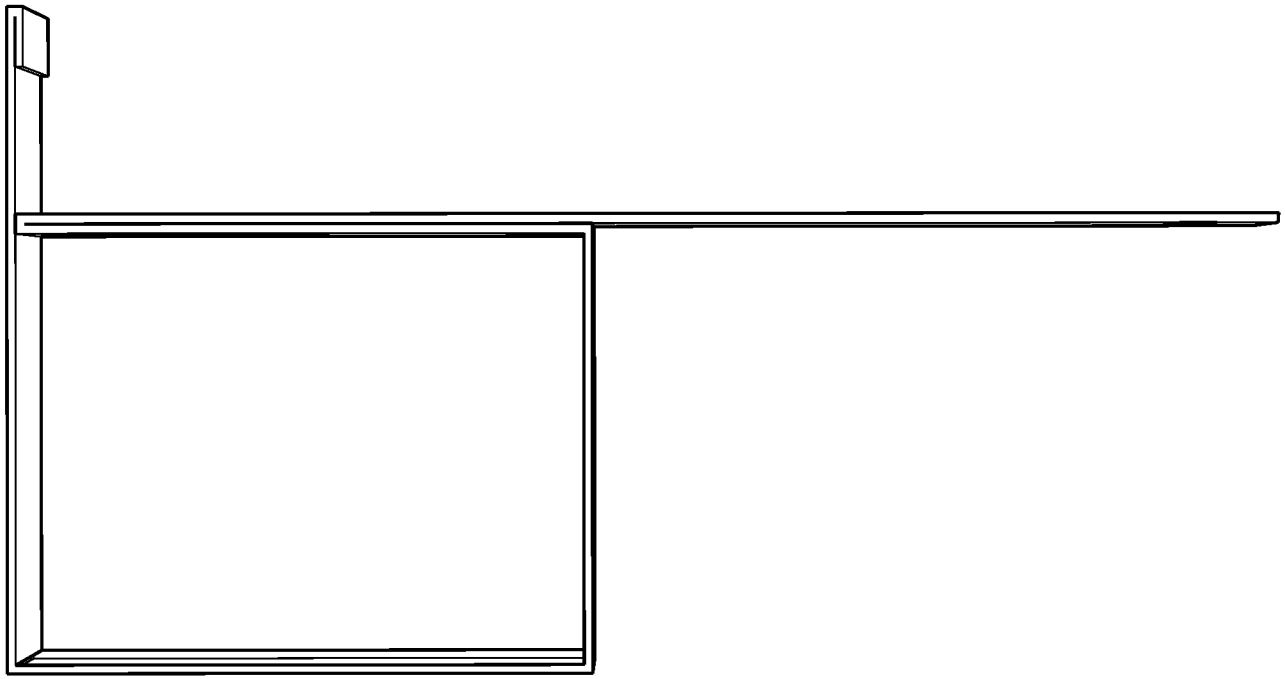
Figure 24:
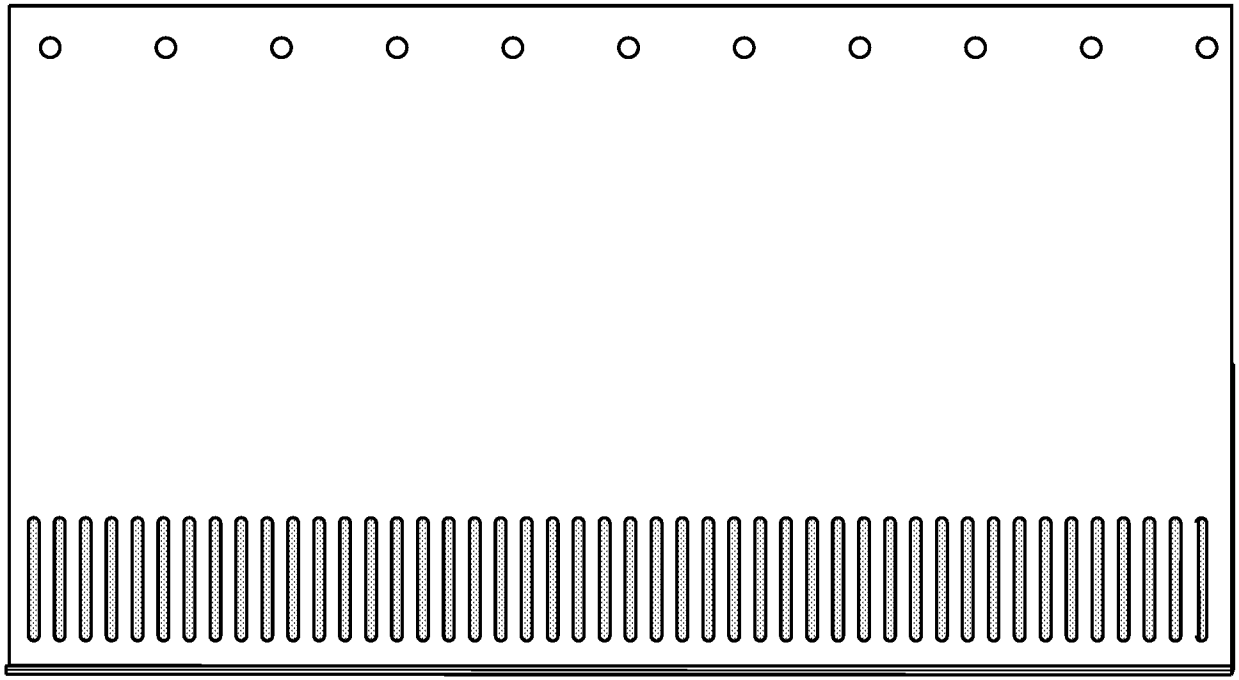
Figure 25:
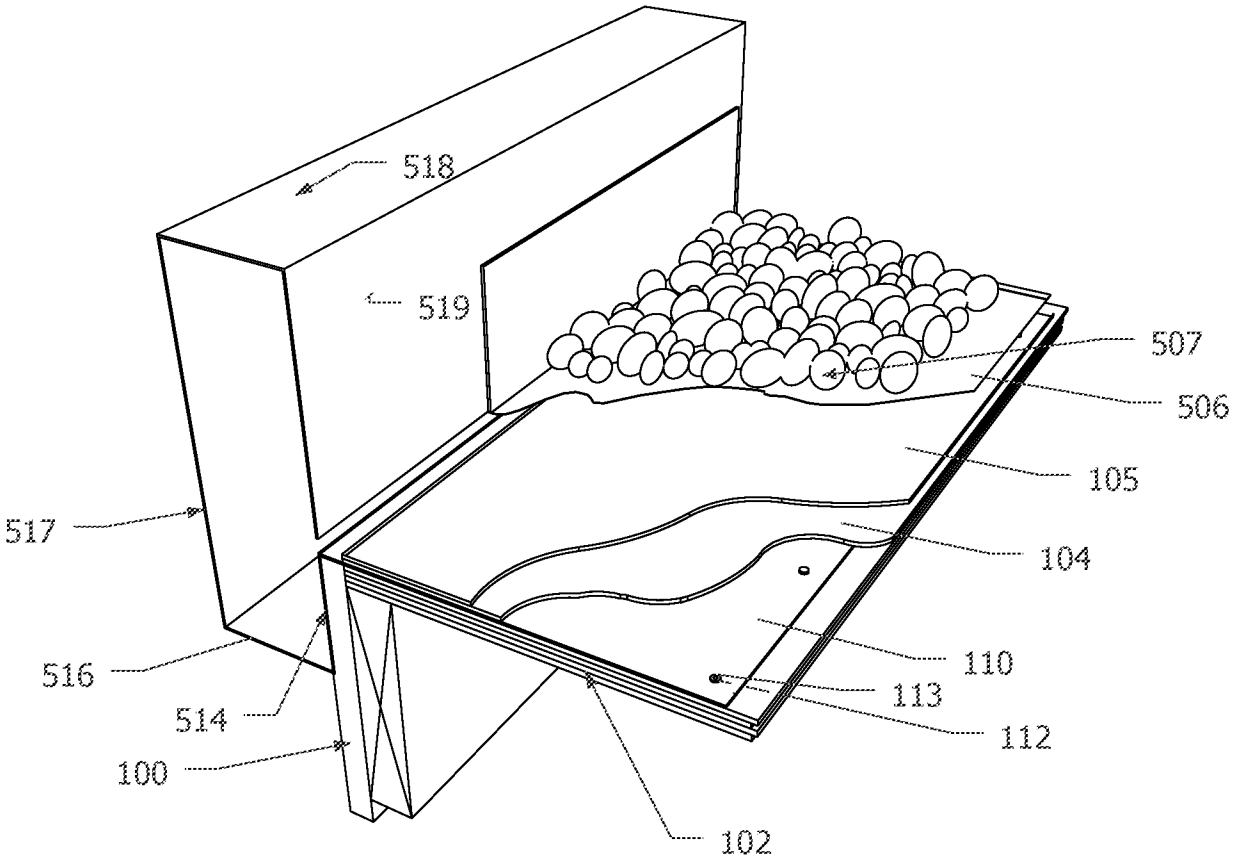
FIGS. 25-27 depict yet another variation of the integrated flashing edging and gutter device, but here the integrated gutter is much higher, extending vertically above the roof edge itself.

FIGS. 19-21 show exemplary edging flashing provided with an upper horizontal leg that extends forward from the roof so as to support an overhang of roofing material, then folds under itself and forms, with downward vertical, horizontal, and upwards vertical portions, a rectangular trough, whose forward face abuts and thus holds the front edge of the overhanging roofing material according to an alternate exemplary embodiment of the present disclosure.

As shown in FIGS. 19-21, a roofward horizontal leg 410 (a seventh planar portion) of flashing is laid flat along the roof top. In this embodiment, the flashing is fastened to substrate 102 via holes 112 located along the inward edge of the flashing. An appropriate construction adhesive may be used to adhere horizontal leg 410 to the roof deck as well. Roofing membrane 104 can be adhered over the top of the flashing using the appropriate adhesive extending to the roof edge. An extra piece of membrane can, for example, be installed over the entire roof 105. Finally, surface material 106 can be installed over the roof, horizontal leg 410 and roofing membranes 104 and 105.

Horizontal leg 410 (the seventh planar portion) continues towards the roof edge along a substantially horizontal plane past the leg that goes down, which is inside vertical leg 414 (a second planar portion), but short of the outside vertical leg 418 (a fourth planar portion), leaving a gap between the end of leg 410 and the vertical plane of outside vertical leg 418. 5 At its farthest forward point leg 410 folds on itself, and returns roofward as horizontal leg 411 (a first planar portion), which doubles back underneath horizontal leg 410 to the roof edge. A trough is formed by inside vertical leg 414, a horizontal bottom leg 416 (a third planar portion) and outside vertical leg 418. At the top of outside vertical leg 418, a hem 419 (a sixth planar portion with a fifth planar portion created by the fold between vertical leg 418, the fourth planar portion, and hem 419, the sixth planar portion) is provided on the inner edge, which can make contact with surface material 106.

Thus, the exemplary flashing illustrated in FIGS. 19-21 can serve as an edging for installed surface material as well as a water management system much like a gutter. The double thickness of the flashing material comprised by horizontal leg 410 and doubled back leg 411 creates a stiffer platform for the installation of surface material 106 that goes out from the edge of the roof. The gap between the doubled up flashing material 410, 411 and outside vertical leg 418 allows water to fall into the gutter-like trough. Hemmed edge 419 located on the top of the outside vertical leg 418 provides an edging for surface material 106. Surface material 106 also provides protection from unwanted debris falling into the gutter-like trough.

It is noted that this embodiment of FIGS. 19-21, provides an edging and also performs like a gutter, having a more traditional box style gutter appearance. Other variations may be made to look like a K-style, or half round gutter, for example, as may be desirable.

FIG. 4B show a variation of the exemplary flashing shown in FIGS. 19-21, where the double thickness horizontal leg comprised of horizontal legs 410 and 411 protrudes sufficiently far away from the roof so as to touch the outside vertical leg 418, forming a rectangular tube structure, and where said double thickness horizontal leg portion is further perforated or provided with numerous slots to allow water to enter the rectangular trough, and thereby drain the roof runoff, according to exemplary embodiments of the present disclosure.

In this exemplary embodiment, as in all the embodiments of FIGS. 13-31, the gutter portion of the flashing may be drained using any appropriate means, including downspouts, rain chains, or the like.

Moreover, as noted above, the flashing variations shown in FIGS. 13-15 and each of FIGS. 19-25 can, for example, have a fin attached to the outside or forward vertical (or substantially vertical, for a curved embodiment) edge that could catch water that flowed off of the installed surface material onto the outside of the flashing. The fin may further be provided with holes, like scuppers, located along the fin that can, for example, allow water to flow back into the trough instead of dropping the water on the ground in an uncontrolled manner.

FIGS. 26-29 show an alternate exemplary edging flashing with a rectangular shape that creates a gutter-like trough, has a vertical leg (519) that abuts against a roofs surface material, and further has a gap between it and a horizontal leg coming off of the roof allowing water to enter the gutter-like trough, according to alternate exemplary embodiments of the present disclosure. In this exemplary embodiment the forward and rearward vertical portions 517 and 519 both extend upwards well above the roof top, creating a larger interior space in the rectangular tubular gutter, and a higher vertical supporting wall 519 for any surface material on the roof.

As can be seen, FIGS. 26-29 depict an alternate exemplary edging flashing that has a flatter profile on the vertical plane and forms a rectangular trough. Thus, horizontal leg 110 of flashing is laid flat along the roof top. As noted, it may be fastened to substrate 102 via holes 112 located along the inward edge of the flashing. Alternatively, an appropriate construction adhesive may be used to adhere this leg to the roof deck. Roofing membrane 104 may be adhered over the top of the flashing, using an appropriate adhesive, extending to the roof edge. An extra piece of roofing membrane 105 may also be installed over the entire roof Around the perimeter of the roof, gardening fabric (or like material) 506 may be installed over roofing membranes 104 and 105, over horizontal leg 110 of the flashing and partially up the upper (i.e., roof facing) inside vertical leg 519 of the flashing. Installed over the gardening fabric may be ballasts 507.

From the edge of the roof, a lower inside vertical leg 514 protrudes downward transitioning to a flat horizontal bottom leg 516, which itself transitions to an outside vertical leg 517 that extends upwards, past the plane of horizontal roof sitting leg 110. The outer vertical leg continues upwards where it transitions to top horizontal leg 518, which as it reaches the same plane as inside vertical leg 514, turns downwards, transitioning to upper inside leg 519 which extends downwards to abut the installed surface material.

In this exemplary embodiment there is a gap between upper inside vertical leg 519 and horizontal leg 110 to allow water to flow into the trough created by legs 514, 516 and 517. Thus the exemplary flashing as illustrated in FIG. 5A may be used as edging for installed surface material, including but not limited to ballasts or soil associated with a green roof, as well as a water management system much like a gutter.

Horizontal leg of flashing 110 is attached to the roof underneath installed surface material 106, which in turn augments the solidity and longevity of the installation. The installed gardening fabric or like material 506, together with the installed surface material, ballasts 507 in this instance, also act like a gutter guard to keep debris such as leaves from entering the trough formed by legs 514, 516, and 517. This embodiment can also be made to be compatible with standard downspout outlets.

Figure 26:
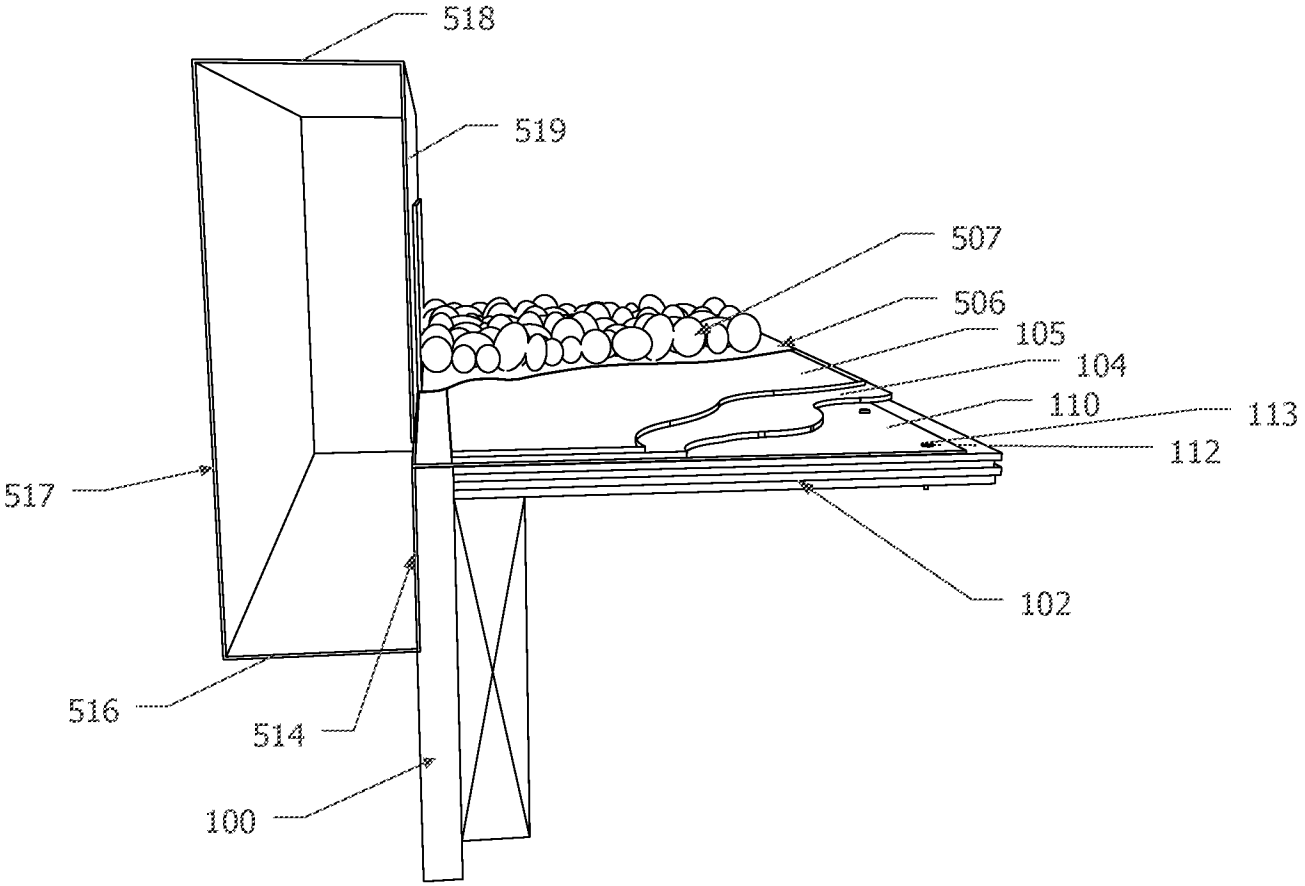
Figure 27:
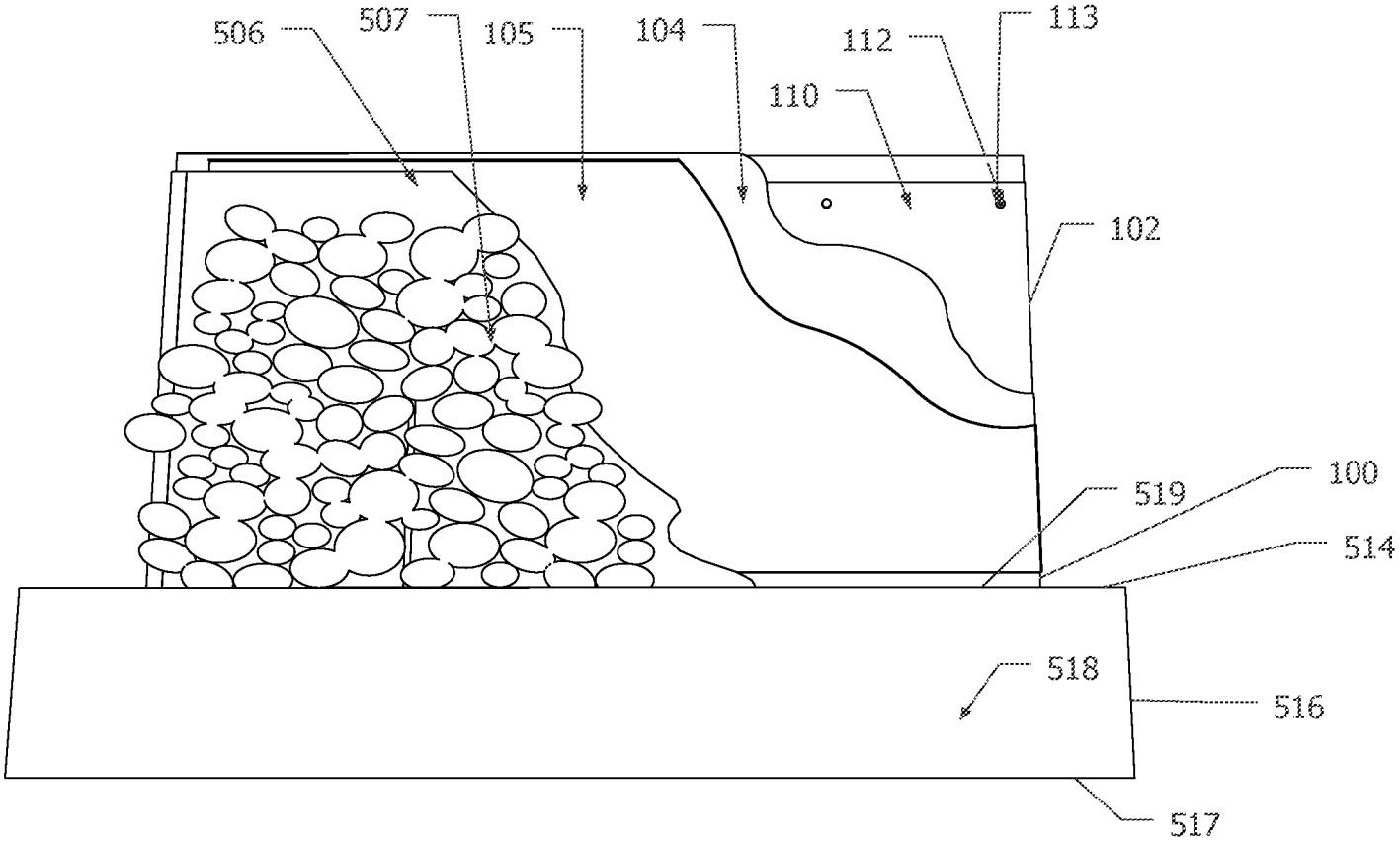
Figure 28:
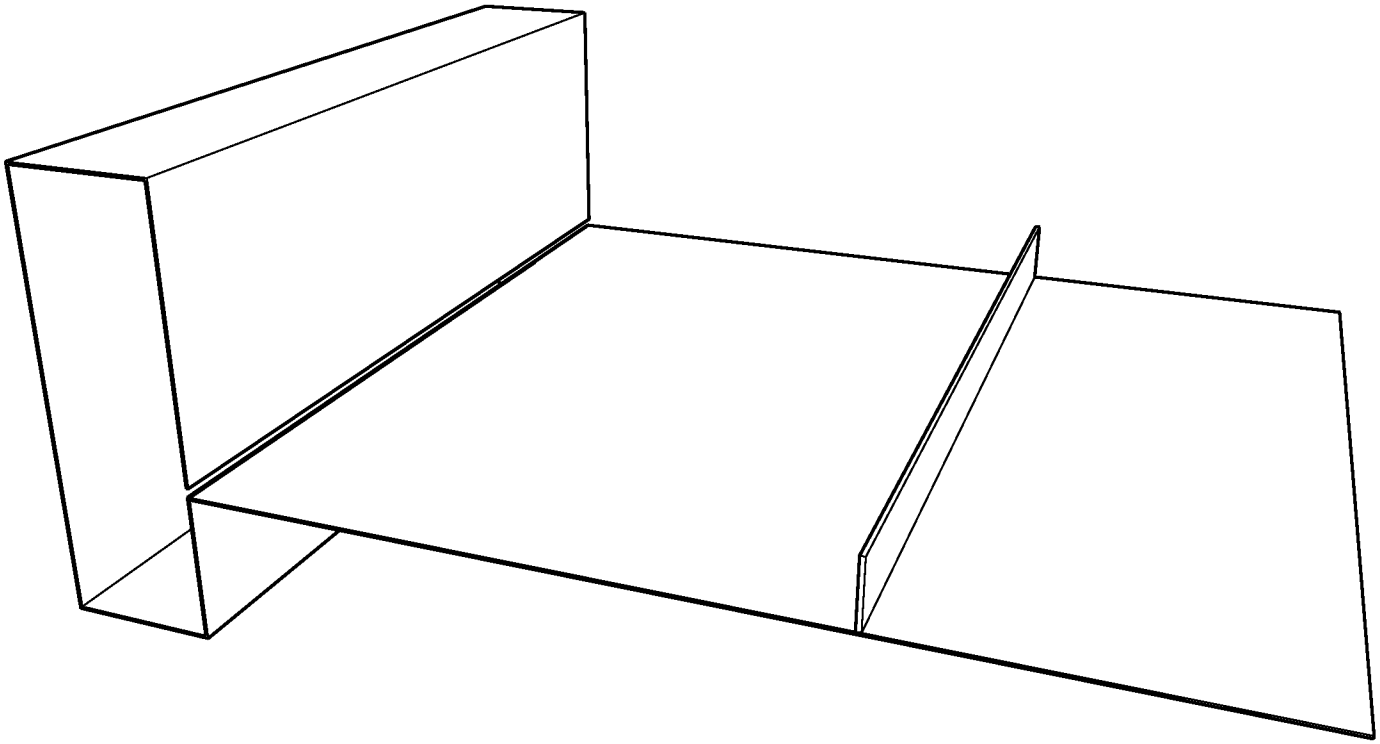
FIG. 28 illustrates a variant of the exemplary embodiment of FIGS. 25-27 with a vertical fin provided some distance roofward of the trough structure, to create two areas in which the installed material sits on the roof, and to thus hold back leaves and water further roofward of the fin.

It is noted that the exemplary embodiment as shown in FIGS. 26-29 provides an edging that also performs like a gutter, and has a rectangular appearance. It is noted that many variations are possible, which variations may be of all sizes and which can vary proportionally from leg to leg. Some variations may incorporate curves or other aesthetic details. One variation can have a upper inside vertical leg 519 with perforations, where the vertical leg 519 actually connects with the transition point of horizontal leg 110 and lower inside vertical leg 514 (as opposed to the gap as shown in FIG. 26). Other variations can have a top horizontal leg 518 that varies in length from bottom horizontal leg 516 so that upper inside vertical leg 519 is inset or overhanging lower inside vertical leg 514.

Further, the exemplary embodiments of FIGS. 26-29 (and 30-31, as described below) need not be limited to flat roof installations. While the angle between transitioning legs 110 and 514 in this variation appears at 90 degrees (conforming to flat roof applications), in other variations this angle can be manufactured to conform to different roof pitches as may be desired or known.

Other Possible Variations to Exemplary Embodiment of FIGS. 26-29

Diagonal slits forming upward facing teeth-like triangles may be located along inside vertical leg 519 to allow for easy attachment of gardening fabric. Another variation can utilize a clip placed over the top of the flashing that can hold the installed gardening fabric in place. Yet another variation can include a fin located along a point on upper inside vertical leg 519. The fin can serve to hide the gardening fabric or installed drainage material. The fin in conjunction with a clip can be used to hold gardening fabric, or the like. The fin can serve as a screed surface for pouring concrete.

Figure 29:
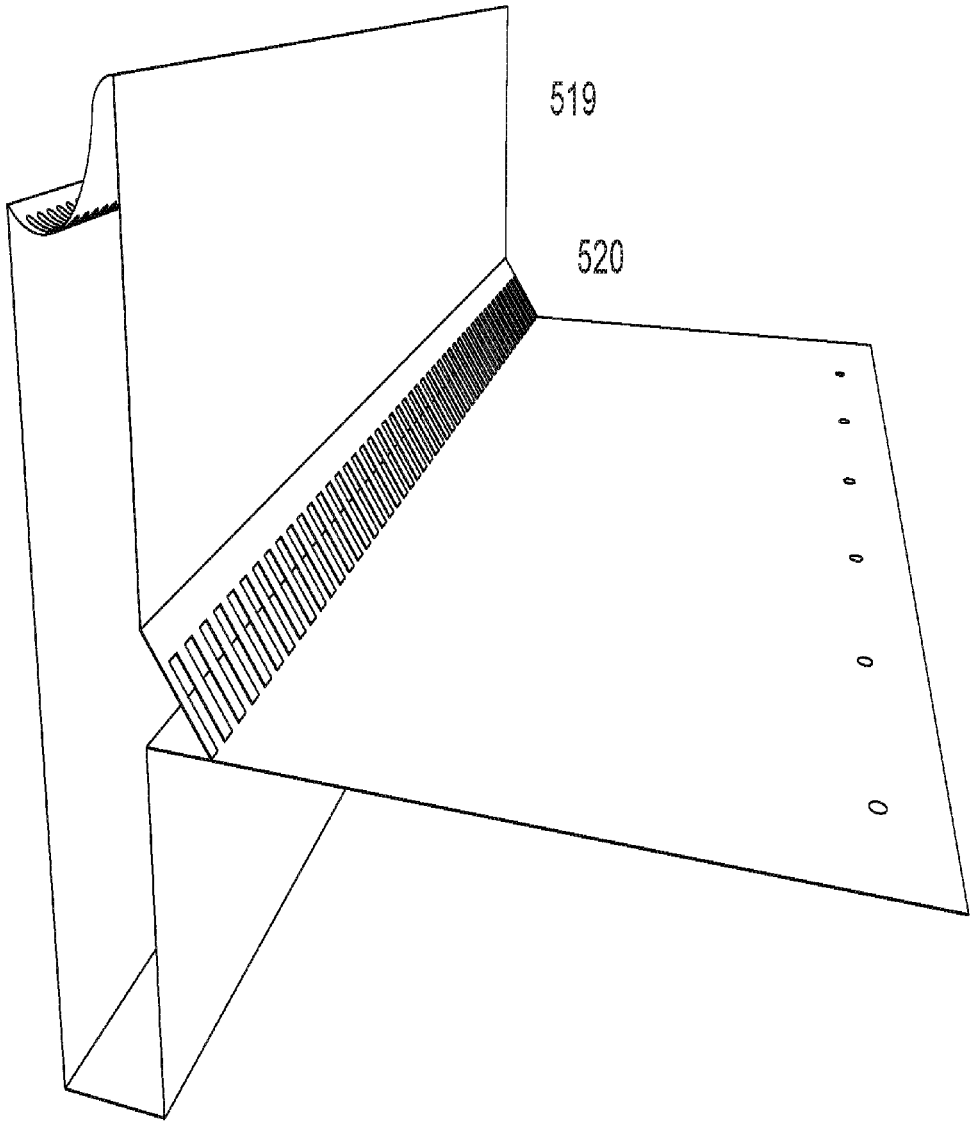
FIGS. 29-31 depict yet another variation of the integrated flashing edging and gutter device of FIGS. 26-28, but here on the roofward side of the flashing edging, the integrated gutter is much higher, extending vertically above the roof edge itself.

Finally, in yet another variation, there can be located along horizontal leg 110 one or more multiple fins with or without perforations, protruding upwards and parallel to vertical legs 517 and 519. These fin(s) could serve as a transitional edging from one installed surface material to another. For example as a transition from ballasts, to live roof, to patio pavers. This is shown in FIG. 29.

Figure 30:
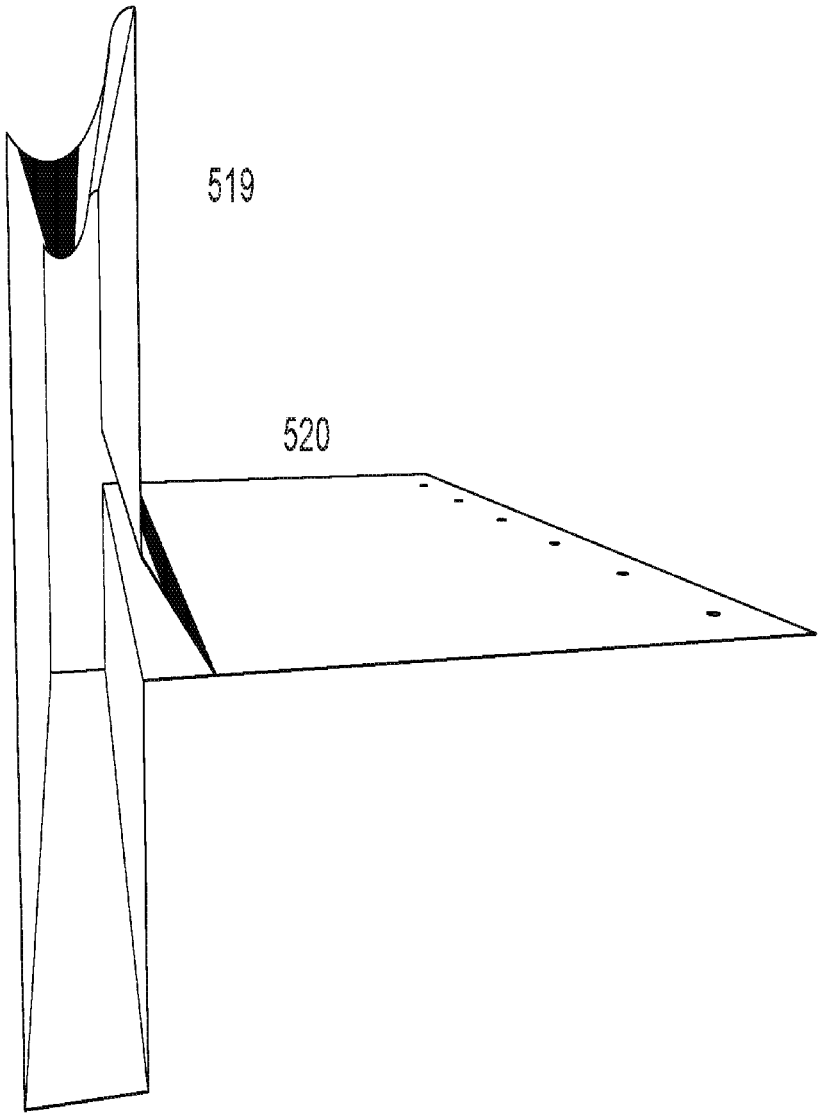
Figure 31:
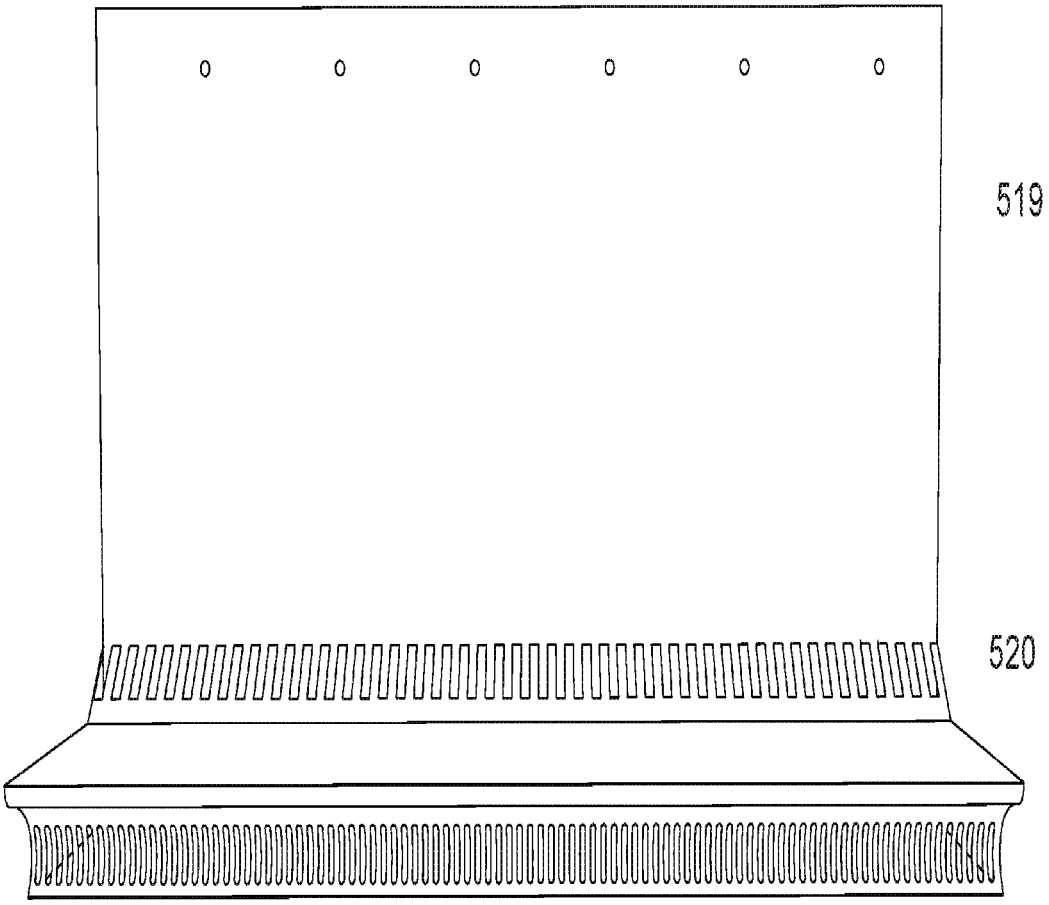

FIGS. 30-31 illustrate a variation of the exemplary flashing shown in FIGS. 26-29 where the analogue of upper or top horizontal leg 518 is swale shaped and contains perforations. This allows for a user or homeowner to clean the gutter-like trough with a hose.

FIGS. 30-31 also shows another variation of the embodiment of FIGS. 26-29. Here the analog of inside vertical leg 519, at its lowest level, instead of leaving a gap in relationship to horizontal leg 110, transitions to a an angled leg 520 that extends down onto and touches horizontal leg 110. Located on diagonal leg 520 are perforations to allow water to flow into the trough created by legs 514, 516 and 517 of the gutter-like trough. There are various advantages of including portion 520 as shown in FIG. 5B. These include: (1) it can help support gardening fabric that could otherwise get pulled into the gap between horizontal leg 110 and vertical leg 519; (2) there is a lesser likelihood of collecting dirt on diagonally angled portion 520; and (3) during heavy rains, or when cleaning with a hose, the angle and support provided by 520 aid in clearing any debris that might otherwise get stuck in the corner of the gardening fabric.

Advantages of the Features of Exemplary Embodiments of FIGS. 26-31

The exemplary flashing embodiments illustrated in FIGS. 26-31 serve as an edging for installed surface materials as well as a water management system much like a gutter. The strength derived from the contact to the roof and the fascia allow for a strong tall profile that can handle the pressure created by ballasts associated with a green/live roof. Further, the tall profile is ideal for hiding understructure of other thicker surface material such as wooden decks. These embodiments would also be useful given the added pressure of a pitched roof application.

As shown in FIG. 30, upward V-shaped tooth-like slits in the mid to upper portion of leg 519 can be located for easy connection of gardening fabric or other material. Another option for connecting gardening fabric can include running fabric over the top horizontal leg 518 of the flashing, with a U-shaped clip friction fitted over the top (with or without special notches). This approach of applying gardening fabric can prove useful for keeping silt/dirt out of the gutter-like trough.

The various disclosed embodiments described above represent a single piece of flashing, for ease of installation and economy of manufacturing, serving as a decorative, structural, and flexible edging that allows for water drainage off of the roof structure.

While the above description contains many specificities, these specificities should not be construed as limitations to the scope, but rather as an exemplification of several preferred embodiments thereof. Many other variations are possible. For example, the V-shaped trough described in the embodiment, of FIGS. 1-3, can be changed to a U-shaped trough with perforations on the rounded bottom. The perforations along the bottom can be various shapes, sizes, and spacing or the perforations can be eliminated allowing the trough to function like a gutter with downspouts or "rain chains."

Matrix of Exemplary Uses and Advantages of Embodiments of FIGS. 1-31

The following matrix provides exemplary uses and advantages of each of the embodiments shown in FIGS. 1 through 31, in a summary, easy to view manner:

| FIGS. | Description of Variation | When to Use | Advantages | End Pieces |
|---|---|---|---|---|
| 1-12 | Leg coming off of roof connection to V-shaped trough with holes for water management. Outer portion abutting surface material serving as edging. | Utilize with membrane roof to serve as edging for materials such as, but not limited to, pavers. When utilizing a gutter with the flashing. Also possible for dryer climates where rain | Simplicity of manufacturing; Ability to taper Streamline appearance Compatibility with concrete | N/A |

-continued

| FIGS. | Description of Variation | When to Use | Advantages | End Pieces |
|---|---|---|---|---|
| | | chains might be utilized instead of gutters. When reversing the pitch of water flow, utilizing a tapered profile. When pouring concrete over roof membrane. | Compatibility with rain chains<br>No need for extra pieces for ends and outside corners (can be cut and bent for corners, doesn't need closed ends if emptying into gutter. | |
| 13-15A | Leg coming off of roof is connected to curved leg that creates a gutter-like trough. | Utilize when flashing and gutter in one pierce is desired, or when a round appearance of edging around the perimeter is desired or, when utilization of common downspouts is desired. | Simply to manufacture.<br>Can be compatible with comment existing down spouts.<br>Less likely to get clogged from debris. | Fitted end pieces and corner pieces matching the profile can be manufactured. |
| 16-18 | Leg comes off roof and connects to legs forming a rectangular trough with an upper portion, that acts as edging, containing a swale with perforations. | Utilize when flashing and gutter in one piece is desired, or when it is desired that the flashing echo and integrate with traditional trim details. | Aesthetically complements traditional wood trim applications.<br>Catches water traveling over the outside of the flashing during heavy rains. | Fitted end pieces and corner pieces matching the profile can be manufactured. |
| 19-25 | Leg comes off roof and doubles back connecting to legs forming rectangular trough either with gap between horizontal leg and outside vertical leg or if horizontal leg connects with outer vertical leg perforations are located in outer portion of double backed horizontal leg. | Utilize when minimal rectangular appearance around the perimeter is desired or, when utilization of common downspouts is desired or, when applied surface material can be, (desired), to cantilever over the perimeter of the roof structure. | Minimal appearance.<br>Can be used with common existing downspouts. | Fitted end pieces matching the profile can be manufactured. Corners could be mitered onsite. |
| 26-31 | Leg comes off roof and connects to rectangle that allows water to enter thus serving as a gutter. | Utilize with green/live roof.<br>Also can work with wooden decks. | Works well for thicker installed surface material such as ballasts, soil and plants or decks with understructure.<br>Works in combination with gardening fabric and ballasts or drainage systems to manage dirt and water drainage.<br>Can be made to work with sloped roofs.<br>Strength/stiffness is derived from connection to the roof that is fortified by the installed surface material as well as abutting the fascia. | Fitted end pieces matching the profile can be manufactured. Corners could be mitered onsite. |

General Considerations (Applicable to all Embodiments)

In exemplary embodiments of the present disclosure, exemplary flashing can be installed over a roofing membrane instead of underneath it. In such cases, larger holes can be located towards the inner edge of the horizontal leg. These larger holes can augment adhesion of the sandwiched horizontal leg of flashing along the perimeter where the lower roofing membrane and upper slip sheet of roofing membrane may be adhered. Another method of fastening the flashing can be the use of a compatible adhesive flashing tape to adhere flashing to the lower sheet of roofing membrane, for example.

In exemplary embodiments of the present disclosure, flashing can be tapered to account for such things as the differential of the slope of the roof and the pitch of the gutter. For example, if the flashing is installed on a flat roof over a porch that is sloped away from the house (but where the gutter is pitched towards the house, because the down spouts for the gutters are located near the house), then the flashing can be tapered so that the V-shaped trough is taller near the house, thus compensating for the greater distance from the roof edge to the gutter.

The flashing can have a tape attached over the opening of the trough to keep out unwanted debris during installation. The flashing can also utilize a tape so that during a concrete pour the concrete will not fill the trough. After the concrete is cured, the tape can be cut or pulled to allow water to flow into the trough. The flashing can be used with attached landscape fabric (or similar material) spanning the trough for a green roof.

In exemplary embodiments of the present disclosure, the flashing can have wire mesh or perforated metal spanning the trough to provide extra support for an installed surface material in embodiments where the surface material extends past the roof edge.

Another variation can eliminate the horizontal leg of the flashing. Such a variation would be attached to the fascia instead of the top of the roof before canting into the V-shaped trough or curved gutter shape or other shapes. Holes located along the outside leg of this type of flashing can make it easier to attach the flashing to the fascia with mechanical fasteners. These holes could vary in size and shape and be considered decorative. In conjunction with such a variation, a piece of rigid material running horizontal can be installed as a clamping device for a roofing membrane (if the roofing membrane were to lap down the inside vertical leg).

The flashing can be made out of many different materials preferably resistant to rust or decay. Such materials may include, for example, coated (finished, painted) steel or aluminum, copper, stainless steel, plastics, and composites. Any color would be possible, making the flashing a complimentary color accent to homes, buildings, and terraces.

Although specific embodiments of the disclosure have been disclosed, those having ordinary skill in the art will understand that changes can be made to the specific embodiments without departing from the spirit and scope of the invention. The scope of the invention is not to be restricted, therefore, to the specific embodiments. The above-presented description and figures are intended by way of example only and are not intended to limit the present invention in any way except as set forth in the following claims. It is particularly noted that persons skilled in the art can readily combine the various technical aspects of the various elements of the various exemplary embodiments that have been described above in numerous other ways, all of which are considered to be within the scope of the invention.

What is claimed is:

1. A flashing for flat roofs or decks comprising:

a first horizontal planar portion with a first edge;

a second vertical planar portion that extends downwards from the first edge and includes a second edge;

a third horizontal planar portion that extends from the second edge of the second planar portion and includes a third edge;

a fourth vertical planar portion that extends upwards from the third edge and above an installed surface material provided on top of the first horizontal planar portion, and includes a fifth edge, wherein the second planar portion, the third planar portion and the fourth planar portion define a trough;

a fifth horizontal planar portion that extends from the fifth edge towards the roof or deck and includes a sixth edge;

a sixth vertical planar portion that extends downwardly from the sixth edge of the fifth planar portion and abuts against the installed surface material; and a seventh horizontal planar portion traversing the trough, parallel to the first horizontal planar portion, and including perforations for fluid passage.

2. The flashing of claim 1, wherein the sixth planar portion extends vertically toward the first horizontal planar portion.

3. The flashing of claim 1, wherein the sixth planar portion extends vertically towards the first horizontal planar portion and includes a gap between the sixth planar portion and the first horizontal planar portion.

4. The flashing of claim 1, wherein the flashing is made of metal.

5. The flashing of claim 1, wherein the first planar portion, the second planar portion, the third planar portion, the fourth planar portion, the fifth planar portion, and the sixth planar portion are manufactured as a single piece.

6. The flashing of claim 1, wherein at least two of the first planar portion, the second planar portion, the third planar portion, the fourth planar portion, the fifth planar portion, and the sixth planar portion are manufactured as separate pieces.

7. The flashing of claim 1, wherein the installed surface material is also supplied on top of the seventh planar portion.

8. The flashing of claim 1, wherein a first junction is formed where the second vertical planar portion extends downwards from the first edge;

wherein a second junction is formed where the third horizontal planar portion extends from the second edge;

wherein a third junction is formed where the fourth vertical planar portion extends upwards from the third edge;

wherein a fourth junction is formed wherein the fifth horizontal planar portion extends from the fifth edge; and wherein a fifth junction is formed wherein the sixth vertical planar portion extends downwardly from the sixth edge.

9. A flashing for flat roofs or decks, comprising:

a first horizontal planar portion with a first edge;

a second vertical planar portion that extends from the first edge and including a second edge;

a third horizontal planar portion that extends from the second edge of the second planar portion and includes a third edge;

a fourth vertical planar portion that extends from the third edge and past a bottom edge of an installed surface material provided on top of the first horizontal planar portion and includes a fourth edge, and wherein the second planar portion, the third planar portion and the fourth planar portion define a trough;

a fifth planar portion that extends inwardly from the fourth edge and towards the roof or deck and includes a fifth edge;

a sixth planar portion that extends downwardly from the fifth edge and abuts the installed surface material; and a seventh planar portion traversing the trough, parallel to the first horizontal planar portion, and including perforations for fluid passage.

10. The flashing of claim 9, wherein at least one of the fifth planar portion or the sixth planar portion includes perforations.

11. The flashing of claim 10, wherein the flashing is made of metal.

12. The flashing according to claim 9, wherein the first planar portion, the second planar portion, the third planar portion, the fourth planar portion, the fifth planar portion, and the sixth planar portion are manufactured as one piece.

13. The flashing of claim 9, wherein at least two of the first planar portion, the second planar portion, the third planar portion, the fourth planar portion, the fifth planar portion, and the sixth planar portion are manufactured as separate pieces.

14. A flashing for a roof or a deck comprising:

a first horizontal planar portion for attachment to the roof and including a first edge;

a second vertical planar portion that extends downwardly from the first edge and includes a second edge;

a third horizontal planar portion that extends outwardly from the second edge and includes a third edge;

a fourth vertical planar portion that extends upwardly from the third edge and past a bottom edge of an installed surface material provided on top of the first horizontal planar portion and includes a fourth edge, wherein the second planar portion, the third planar portion and the fourth planar portion define a trough for fluid runoff;

a fifth horizontal planar portion that extends inwardly from the fourth edge and towards the roof or deck and includes an fifth edge;

a sixth vertical planar portion that extends downwardly from the fifth edge and abuts against the installed surface material, the fifth planar portion and the sixth planar portion creating a hem at the fourth edge; and a seventh horizontal planar portion traversing the trough, parallel to the first horizontal planar portion, and including perforations.

15. The flashing of claim 14, wherein at least one of the fifth planar portion or the sixth planar portion includes perforations.

16. The flashing of claim 14, wherein the flashing is made of metal.

17. The flashing of claim 14, wherein the first planar portion, the second planar portion, the third planar portion, the fourth planar portion, the fifth planar portion, and the sixth planar portion are manufactured as one piece.

18. The flashing of claim 14, wherein at least two of the first planar portion, the second planar portion, the third planar portion, the fourth planar portion, the fifth planar portion, and the sixth planar portion are manufactured as separate pieces.

* * * * *